US011383867B2

(12) United States Patent
Berger et al.

(10) Patent No.: US 11,383,867 B2
(45) Date of Patent: Jul. 12, 2022

(54) SPEAR CENTER FILLER APPARATUS

(71) Applicant: Solbern Inc., Fairfield, NJ (US)

(72) Inventors: Thomas G. Berger, Ridgefield, NJ (US); Ryan Timothy Ragoza, Westfield, NJ (US); George Stephens, Hewitt, NJ (US); Robert Wall, Mahwah, NJ (US)

(73) Assignee: Solbern Inc., Fairfield, NJ (US)

( * ) Notice: Subject to any disclaimer, the term of this patent is extended or adjusted under 35 U.S.C. 154(b) by 314 days.

(21) Appl. No.: 16/599,759

(22) Filed: Oct. 11, 2019

(65) Prior Publication Data

US 2020/0115084 A1 Apr. 16, 2020

Related U.S. Application Data

(60) Provisional application No. 62/744,727, filed on Oct. 12, 2018.

(51) Int. Cl.
*B65B 43/62* (2006.01)
*B65B 1/12* (2006.01)
*B65B 25/04* (2006.01)

(52) U.S. Cl.
CPC ..... *B65B 43/62* (2013.01); *B65B 1/12* (2013.01); *B65B 25/04* (2013.01)

(58) Field of Classification Search
CPC ..... B65B 43/62; B65B 1/12; B65B 25/04
USPC ..... 53/515, 244
See application file for complete search history.

(56) References Cited

U.S. PATENT DOCUMENTS 2,092,786 A * 9/1937 Taylor ..... B26D 7/0608 99/545
3,461,646 A * 8/1969 Hawk ..... B65B 25/04 53/515
3,468,098 A * 9/1969 Eisenberg ..... B65B 25/04 53/515
3,662,518 A * 5/1972 Eisenberg ..... B65B 25/04 53/515
4,537,017 A * 8/1985 Hengstenberg ..... B65B 39/14 53/236
4,539,879 A * 9/1985 Egee ..... B65B 19/34 198/390
4,646,509 A * 3/1987 Tribert ..... B65B 25/04 53/244
5,121,591 A * 6/1992 Backus ..... B65B 25/04 53/258

(Continued)

*Primary Examiner* — Robert F Long
*Assistant Examiner* — Xavier A Madison
(74) *Attorney, Agent, or Firm* — McCarter & English, LLP

(57) ABSTRACT

Exemplary embodiments are directed to an apparatus for filling a central open space in a jar. The apparatus includes a base, an indexing station including a magazine, a blade, and a first actuator, a filling station including cartridges, and a second actuator. The magazine is rotatably mounted to the base. The platform of the cutting station is configured to receive a whole cucumber at a loading area and is incrementally indexed to reposition the whole cucumber from the loading area to a cutting area above the blade. The first actuator is configured to urge the whole cucumber through the blade and cut the whole cucumber into spears. The spears drop into and are held by one of the cartridges. The second actuator is configure to push at least one of the spears out from the cartridge into the central open space of the jar.

46 Claims, 21 Drawing Sheets

(56) References Cited

U.S. PATENT DOCUMENTS

| | | | | |
|---|---|---|---|---|
| 6,041,577 | A * | 3/2000 | Walz | B65B 25/04 53/236 |
| 6,079,191 | A * | 6/2000 | Borkiewicz | B65B 19/34 53/236 |
| 2013/0177684 | A1* | 7/2013 | Borkiewicz | B65B 25/04 426/397 |
| 2016/0090202 | A1* | 3/2016 | Newman | B65B 7/02 53/514 |

* cited by examiner

SPEAR CENTER FILLER APPARATUS

CROSS-REFERENCE TO RELATED APPLICATIONS

The present application claims the benefit of priority to U.S. Provisional Patent Application No. 62/744,727, filed on Oct. 12, 2018, which is incorporated herein by reference in its entirety.

BACKGROUND OF THE INVENTION

Technical Field

The present disclosure relates to an apparatus for filling a container with a food product and, in particular, to an apparatus for filling a central space of a container with cucumber (e.g., pickle) spears during a bottling operation.

Background

A variety of methods of filling a container with cucumber spears are known in the industry (as used herein, the term "cucumber" includes, but is not limited to, a pickled cucumber, also known as a "pickle"). For example, cucumbers are cut into spears, fed into a jar, and positioned against the inner walls of the jar. After a first row of spears has been positioned in the jar, the process is repeated to fill the jar with additional row(s) of spears approaching the center of the jar. These and/or related operations can be performed by an automated machine, such as the machine disclosed by U.S. Pat. Nos. 4,142,560; 4,646,509; and 6,041,577, the entire contents of each of which is incorporated herein by reference. Although multiple layers of spears are positioned into the jar, traditional machines leave an open space at the center of the jar. The open space is traditionally filled manually by packers prior to sealing the jar for shipment. Manually packing the central open space increases the overall time for completing filling of the entire jar.

A need remains for an apparatus for filling the central open space of a container with spears in an automated and time-efficient manner. These and other considerations are addressed by embodiments of the spear center filler apparatus of the present disclosure.

SUMMARY OF THE DISCLOSURE

In accordance with embodiments of the present disclosure, an exemplary apparatus for filling a central open space in a container, such as a jar, is provided. The apparatus generally includes a base, an indexing station, and a filling station. The indexing station can include a magazine, a blade, and a first actuator, while the filling station can include one or more cartridges. The magazine is configured to receive a whole cucumber at a loading area. The magazine can be rotatably mounted to the base, such that it can be incrementally indexed to reposition the whole cucumber from the loading area to a cutting area that is above the blade. The first actuator is configured to urge the whole cucumber through the blade and cut the whole cucumber into a plurality of spears. Once cut, at least one of the spears drop into and is held by one of the one or more cartridges. The second actuator is configured to push at least one of the spears out from the cartridge and into the central open space of the container.

References made herein to the indexing station and the filling station should not be understood to imply that there are necessarily no components shared between these stations, or that these stations are entirely separable standalone units.

In some embodiments, the one or more cartridges can comprise a first cartridge, a second cartridge, and a third cartridge. The first cartridge can be positioned below the blade and generally does not contain spears, the second cartridge can be positioned above a first container and can contain a first plurality of spears, e.g., four spears, and a third cartridge can be positioned above a second container and can contain a second plurality of spears that is less than the first plurality of spears, e.g., two spears. In such embodiments, upon an actuation the following can occur: (i) the first actuator urges the whole cucumber through the blade cutting the whole cucumber into a third plurality of spears that are transferred into the first cartridge, (ii) the second actuator urges at least one of the first plurality of spears from the second cartridge into a central open space of a first container, and (iii) a third actuator urges at least one of the second plurality of spears from the third cartridge into a central open space of the second container. Upon completion of the actuation, the following can occur: (i) the first and second containers are indexed and replaced by third and fourth containers, (ii) the first cartridge is incrementally indexed to a position above the third container, (iii) the second cartridge is incrementally indexed to a position above the fourth container, and (iv) the third container is incrementally indexed to a position below the blade.

In some embodiments, the apparatus can include a sensor configured to detect if the central open space of the container is obstructed. If the sensor detects an obstruction then it prevents the second actuator from being actuated.

In some embodiments, the magazine can be rotatably disposed within a housing. The indexing station can include a top cover that covers a partial radial portion of the magazine at the cutting area. The loading area of the indexing station can include a tapered infeed chute configured to position a whole cucumber in the magazine, which in some embodiments can define a cylindrical shape with cutouts radially disposed along a perimeter of the magazine. In such embodiments, each cutout can be configured to retain a whole cucumber. In some embodiments, the cutouts can be half-circle cutouts configured to surround half of a whole cucumber. The whole cucumber can be maintained in a vertical position between the magazine and an inner surface of a housing of the indexing station. In some embodiments, the blade can be cross shaped and configured to cut the whole cucumber into four equal spears.

In some embodiments, the filling station can include a top platform and a bottom platform, and the cartridges can be mounted between the top and bottom platforms. The apparatus can include a tube positioned between the indexing station and the top platform of the filling station. The tube can surround the blade.

In some embodiments, the cartridges of the filling station can be rotatably mounted relative to the indexing station such that the magazine can rotate about a first vertical axis and the cartridges can rotate about a second vertical axis, which can be parallel to each other and spaced from each other.

In some embodiments, the cartridges of the filling station can be incrementally indexed to reposition the spears from a position below the blade to a position above a container, e.g., jar, having a central open space. The second actuator can urge a first of two opposing spears from a first cartridge into a central open space of a first container. After loading of the first of the two opposing spears, the first cartridge can be incrementally indexed to a position above a second container. The filling station can include a third actuator configured to urge a second of two opposing spears from the first cartridge into a central open space of the second container. Each of the cartridges can include a housing with plates dividing the housing into equally sized inner chambers configured to receive a spear. Each of the cartridges can include a spring-loaded keeper configured to impart a force on the spear to maintain the spear within the inner chamber and against the respective plate.

In accordance with embodiments of the present disclosure, an exemplary system for filling a central open space in a container is provided that generally includes a filling apparatus and an indexer. The filling apparatus includes a base, an indexing station, and a filling station including one or more cartridges that are rotatably mounted relative to the indexing station. The indexing station includes a magazine rotatably mounted to the base, and a blade. The indexer is configured to move containers along a path below the filling station. The magazine is configured to receive a whole cucumber at a loading area and is incrementally indexed to reposition the whole cucumber from the loading area to a cutting area above the blade. The indexing station includes a first actuator configured to urge the whole cucumber through the blade and cut the whole cucumber into spears, which drop into one of the one or more cartridges that are configured to receive and hold the spears. The one or more cartridges are indexed to reposition the cartridge holding the spears above the container with the central open space. The filling station includes an actuator configured to urge one or more of the spears from the cartridge into the central open space of the container.

In some embodiments, the indexer can be a helical indexer rotatably disposed on one side of the containers. In such embodiments, the system can include a guiding wall disposed on an opposing side of the containers from the helical indexer. In some embodiments, the indexer can move the containers along a substantially linear path below the filling station.

In accordance with embodiments of the present disclosure, an exemplary method of filling a central open space in a container is provided. The method includes providing an apparatus including a base, an indexing station including a blade and a magazine rotatably mounted to the base, and a filling station including one or more cartridges. The method includes loading a whole cucumber into the magazine of the indexing station at a loading area. The method includes incrementally indexing the magazine to reposition the whole cucumber from the loading area to a cutting area above the blade. The method includes urging the whole cucumber through the blade with an actuator of the indexing station to cut the whole cucumber into spears. The method includes transferring the spears into one of the cartridges of the filling station.

In some embodiments, the method can include incrementally indexing the one or more cartridges of the filling station to reposition the spears from a position below the blade to a position above a container having a central open space. In other embodiments, the method includes urging a first of two opposing spears from a first cartridge into the central open space of a first container with a first filling actuator of the filling station. Such methods can include incrementally indexing the first cartridge to a position above a second container, and also urging a second of two opposing spears from the first cartridge into the central open space of the second container with a second filling actuator.

A cartridge for holding cucumber spears according to the present disclosure generally includes a body, a mount extending from the body, and a keeper assembly secured to the mount. The body includes a top opening and a bottom opening, and defines an internal chamber that is configured to receive a cut cucumber spear through the top opening. The keeper assembly includes a keeper arm and a spring that biases the keeper arm radially inward into the internal chamber in order to impart a force on a spear positioned within the internal chamber, to secure the spear within the internal chamber, and to prevent the spear from falling through the bottom opening.

In some embodiments, the top opening can be configured to receive an arm that pushes the spear out from the internal chamber and through the bottom opening. The keeper arm can be secured to the mount by a pin such that the keeper arm is rotatable about the pin. The body can also include a removed section with the keeper arm extending through the removed section and into the internal chamber.

In some embodiments, the cartridge can include one or more plates that divide the internal chamber into a plurality of equally sized inner chambers that are each configured to receive a spear. In such embodiments, the cartridge can include a plurality of mounts equal in number to the number of equally sized inner chambers, and a plurality keeper assemblies equal in number to the number of equally sized inner chambers. Each keeper mount can have a keeper arm and a spring. Each one of the mounts and each one of the keeper assemblies can be associated with one of the inner chambers such that the spring of each keeper assembly biases the respective keeper arm radially inward into the associated inner chamber to impart a force on a spear positioned within the inner chamber to secure the spear within the inner chamber and prevent the spear from falling through the bottom opening. In such embodiments, the body can include a plurality of removed sections equal in number to the number of equally sized inner chambers, and each of the keeper arms can extend through one of the removed sections and into the associated inner chamber.

In accordance with embodiments of the present disclosure, an exemplary centering guide for a food product is provided that generally includes a blade mount ring, a first outer ring, a second outer ring, a pivot mount ring, and a plurality of guide rail subassemblies. The blade mount ring can define a first central opening, and can include one or more blades positioned at least partially within the first central opening. The first outer ring can define a second central opening, and can be configured to translate axially along a central axis. The second outer ring can define a third central opening, and can be configured to translate axially along the central axis. The pivot mount ring can define a fourth central opening, and can be configured to translate axially along the central axis. Each of the plurality of guide rail subassemblies can be mounted with respect to the blade mount ring, the first outer ring, the second outer ring, and the pivot mount ring. Each of the plurality of guide rail subassemblies can include a guide rail, a first linkage subassembly, and a second linkage subassembly. The first linkage subassembly can be rotatably engaged with the guide rail, the first outer ring, and the pivot mount ring. The second linkage subassembly can be rotatably engaged with the guide rail, the second outer ring, and the blade mount ring. The guide rails can be positioned within the first central opening, the second central opening, the third central opening, and the fourth central opening. Additionally, the guide rails can be configured to receive the food product therebetween, and be urged radially outward by the food product from a closed position to an open position when the food product is received between the guide rails. The plurality of guide rail subassemblies can maintain the food product substantially along the central axis when they are urged radially outward by the food product.

In some embodiments, urging the guide rail of at least one of the plurality of guide rail subassemblies radially outward from the central axis can cause the guide rail of each of the other guide rail subassemblies to move radially outward from the central axis and maintain the food product substantially along the central axis.

In some embodiments, the first linkage subassembly can cause the first outer ring and the pivot mount ring to translate axially when at least one of the guide rails is urged radially outward from the central axis. In such embodiments, the first outer ring and the pivot mount ring can be mounted to a plurality of rods and configured to translate axially along the plurality of rods.

In some embodiments, the second linkage subassembly can cause the second outer ring to translate axially when at least one of the guide rails is urged radially outward from the central axis. In such embodiments, the second outer ring can be mounted to a plurality of rods and configured to translate axially along the plurality of rods.

In some embodiments, the first linkage subassembly can include a first pivot linkage and a first forked linkage, and the second linkage subassembly can include a second pivot linkage and a second forked linkage. In such embodiments, the first pivot linkage can be rotatably secured with the guide rail, the pivot mount ring, and the first forked linkage, and the first forked linkage can be rotatably secured with the first outer ring and the first pivot linkage. Additionally, the second pivot linkage can be rotatably secured with the guide rail, the blade mount ring, and the second forked linkage, and the second forked linkage can be rotatably secured with the second outer ring and the second pivot linkage.

In some embodiments, the guide rail can include a tapered face and a substantially vertical face configured to engage the food product. In other embodiments, the plurality of guide rail subassemblies can include four guide rail subassemblies that are equidistantly spaced.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed exemplary embodiment of a spear center filler apparatus, reference is made to the accompanying figures, wherein.

DETAILED DESCRIPTION OF THE PRESENT DISCLOSURE

Figure 1:
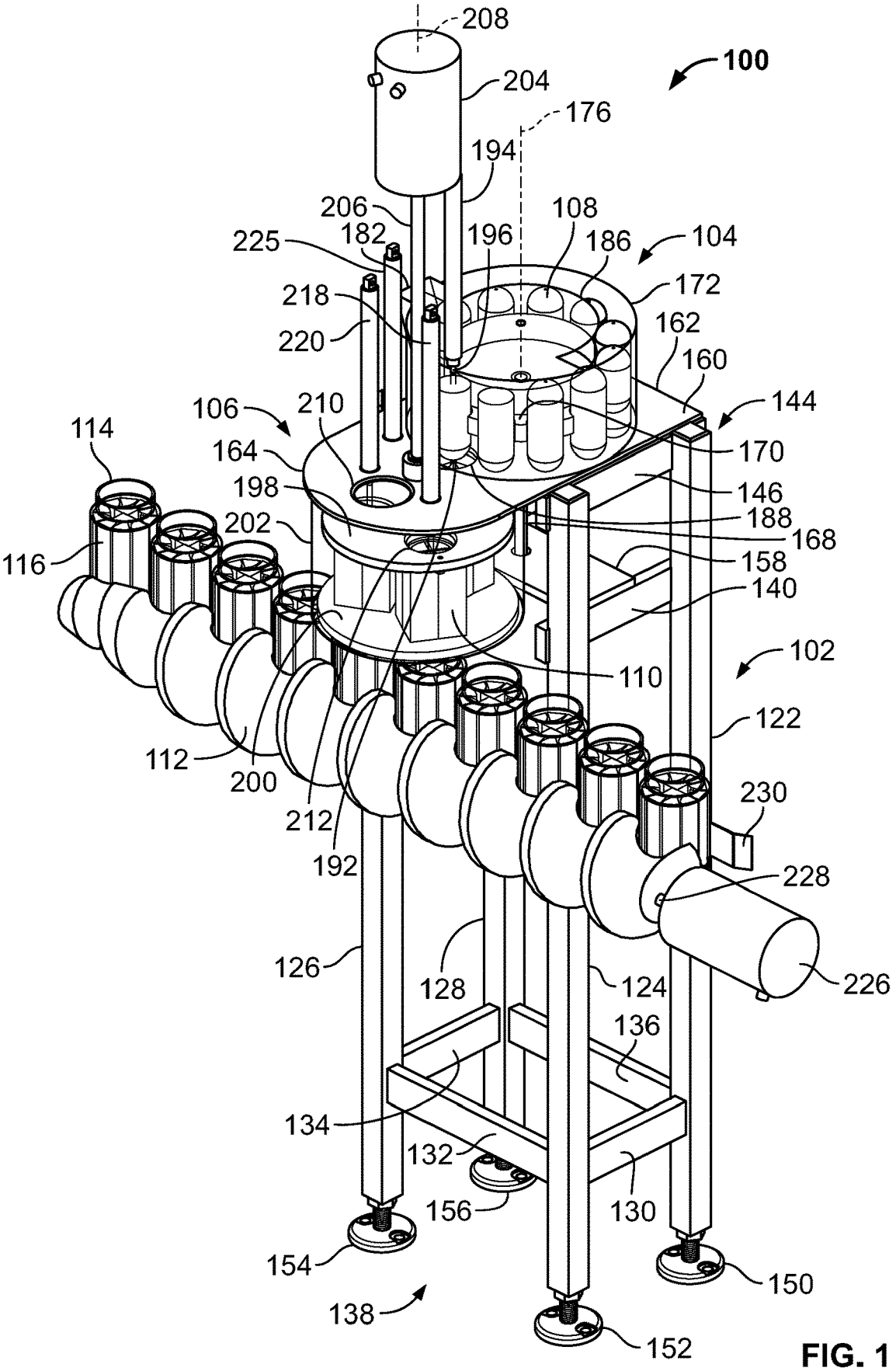
FIG. 1 is a front perspective view of a spear center filler apparatus according to the present disclosure.
Figure 2:
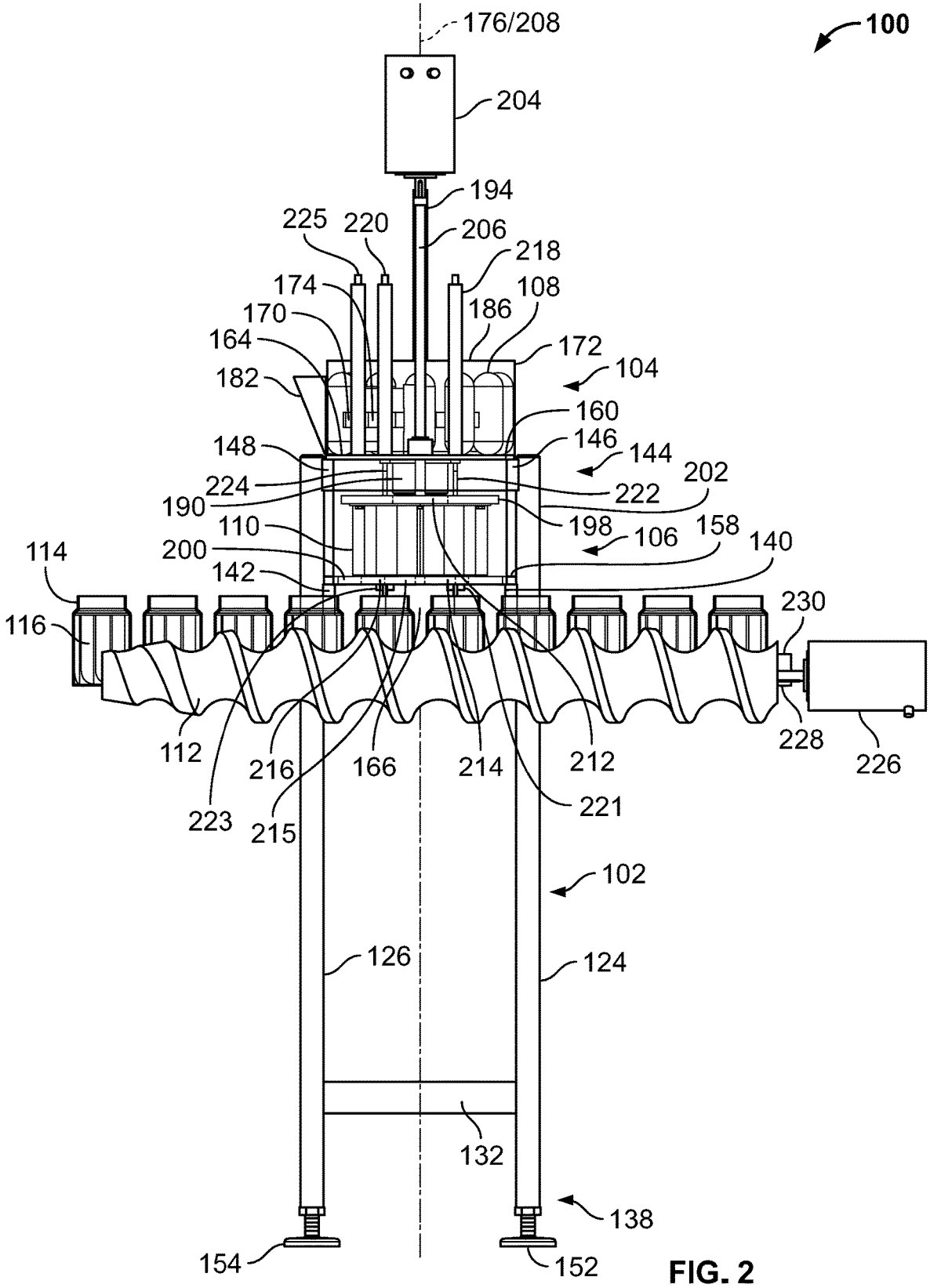
FIG. 2 is a front view of the spear center filler apparatus of FIG. 1.
Figure 3:
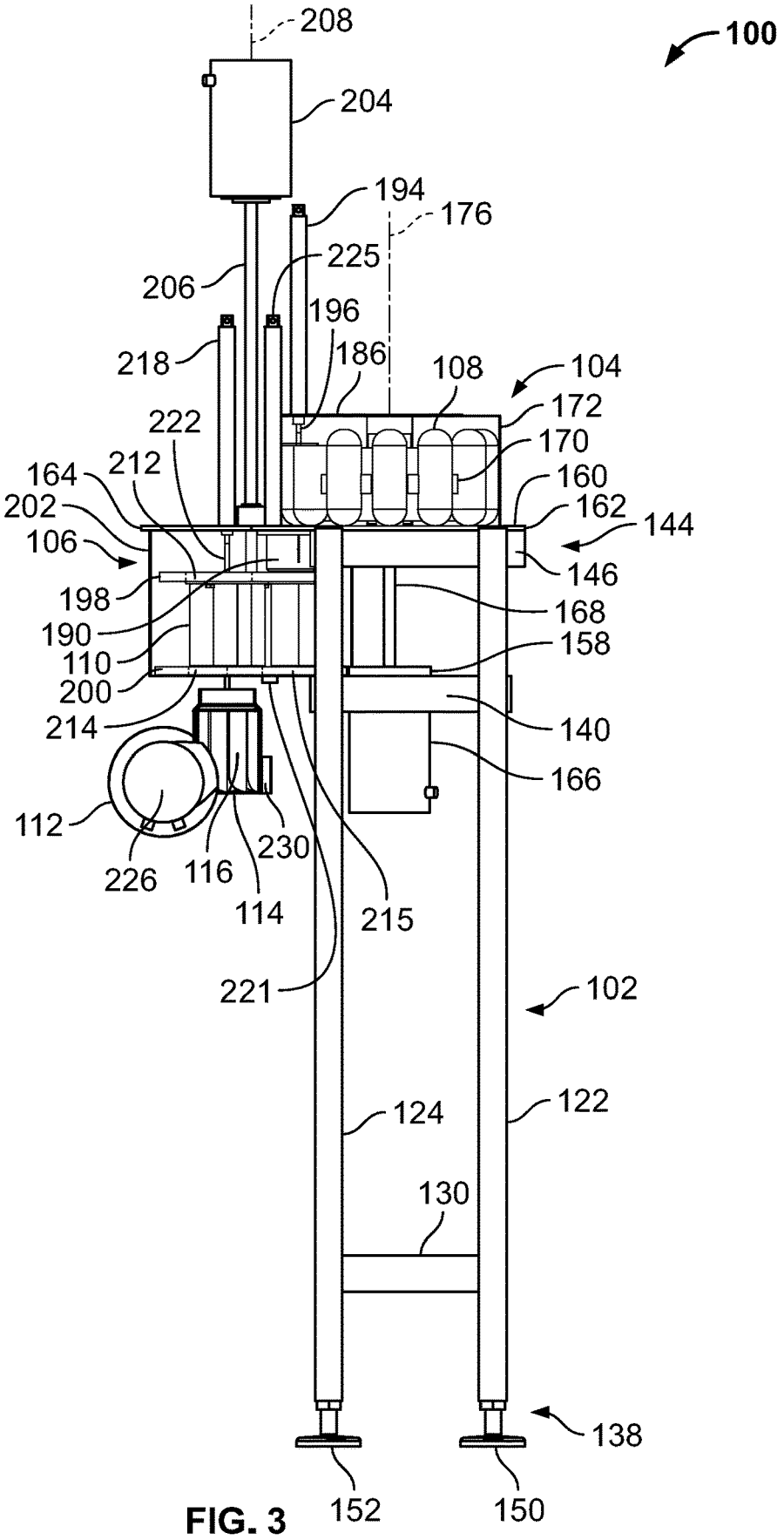
FIG. 3 is a side view of the spear center filler apparatus of FIG. 1.
Figure 4:
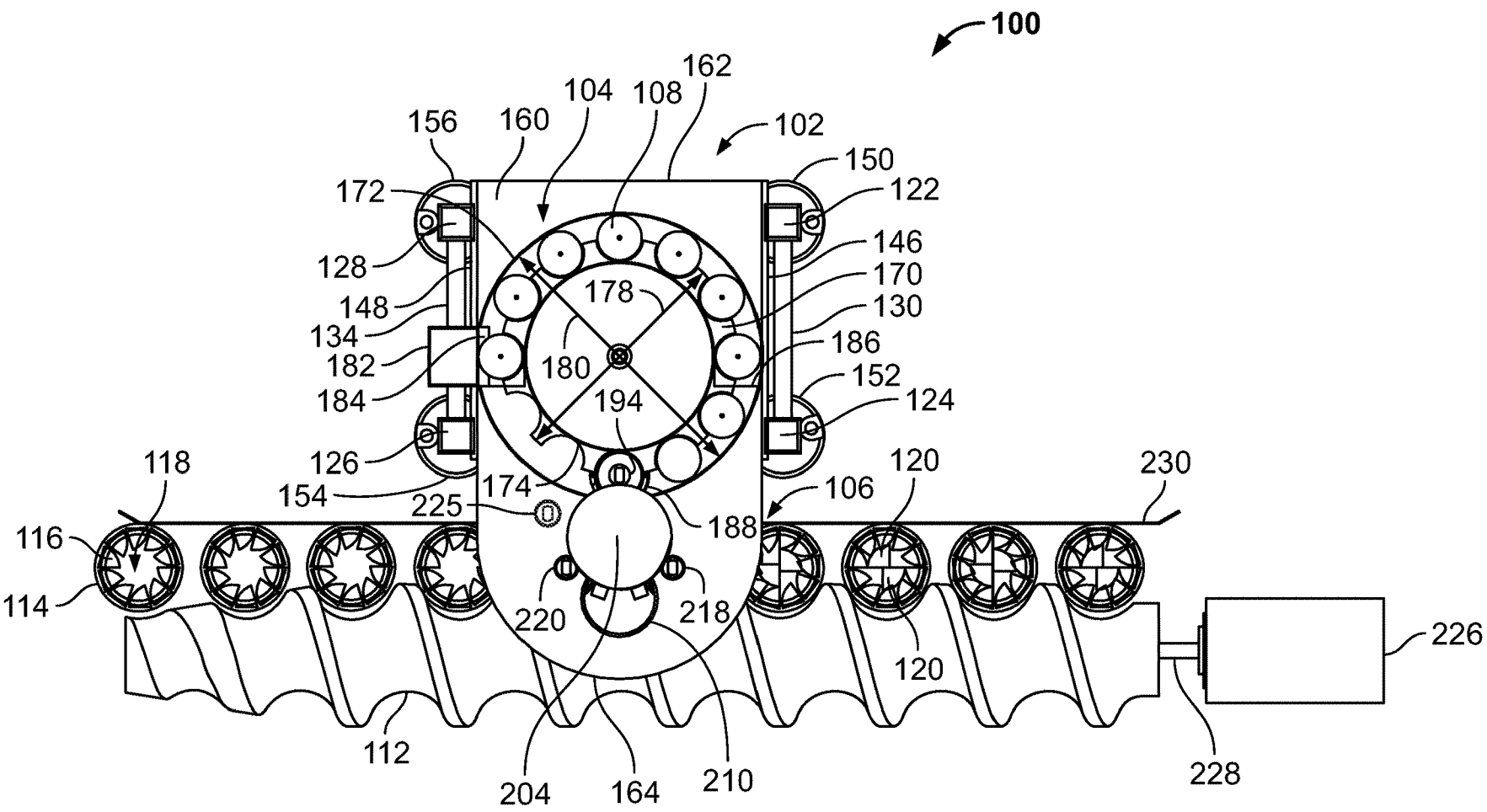
FIG. 4 is a top view of the spear center filler apparatus of FIG. 1.

It should be understood that the relative terminology used herein, such as "front", "rear", "left", "top", "bottom", "vertical", and "horizontal" is solely for the purposes of clarity and designation and is not intended to limit the invention to embodiments having a particular position and/or orientation. Accordingly, such relative terminology should not be construed to limit the scope of the present invention. In addition, it should be understood that the invention is not limited to embodiments having specific dimensions. Thus, any dimensions provided herein are merely for an exemplary purpose and are not intended to limit the invention to embodiments having particular dimensions.

With reference to FIGS. 1-5, perspective, front, side, top, and detailed views of an embodiment of an apparatus 100 for filling the center of a container, e.g., a jar, with spears (e.g., a spear center filler apparatus) is provided. The apparatus 100 includes a base 102, a cucumber indexing station 104 operably mounted to the base 102, and a filling station 106 operably mounted to the base 102. As will be discussed in greater detail below, the indexing station 104 is configured to receive whole cucumbers 108, e.g., via automated and/or manual loading, and selectively indexes the cucumbers 108 over the filling station 106 prior to cutting the cucumber 108, for example, into four substantially equal spears, and transferring the cucumber spears to the filling station 106. The filling station 106 is configured to receive the spears corresponding to a single cucumber 108 in a respective cartridge 110. References made herein to the indexing station 104 and the filling station 106 should not be understood to imply that there are no components shared between these stations, or that these stations are entirely separable standalone units. Additionally, it should be understood that while reference is made herein to cucumbers 108 other food products could be used with the apparatus 100 of the present disclosure.

A helical indexer 112 transfers or moves containers 114, e.g., jars, partially filled with spears 116 to a position below the filling station 106 along a substantially linear path. The filling station 106 transfers one or more spears 120 from the cartridges 110 into the jars 114 to fill the central open space 118 within the jars 114. For example, the jars 114 to the left of the filling station 106 in FIG. 4 include the central open space 118, and the jars 114 to the right of the filling station 106 in FIG. 4 include two spears 120 transferred into the central open space 118 from the filling station 106. Although illustrated as having only two spears 120 in the central open space 118, in some embodiments, four spears 120 can be introduced into the central open space 118 to completely fill the space 118.

The base 102 includes four vertical legs or posts 122, 124, 126, 128 with horizontal cross frames 130, 132, 134, 136 coupled to the posts 122, 124, 126, 128 near the bottom end 138 of the base 102, horizontal cross frames 140, 142 coupled to the posts 122, 124, 126, 128 between the bottom and top ends 138, 144 of the base 102, and horizontal cross frames 146, 148 coupled to the posts 122, 124, 126, 128 at the top end 144 of the base 102. Each of the posts 122-128 includes a foot 150, 152, 154, 156 rotatably coupled to the bottom end 138, with rotation of the individual feet 150, 152, 154, 156 providing adjustment of the elevation of the posts 122, 124, 126, 128. A horizontal mounting plate 158 is mounted between the cross frames 140, 142, and a top mounting plate 160 is mounted at the top end 144 of the base 102 (e.g., coupled to the cross frames 146, 148). In some embodiments, the top mounting plate 160 can define a substantially planar or flat structure with a linear rear edge 162 and a rounded front edge 164.

The indexing station 104 includes a magazine 170 and a substantially cylindrical housing 172 that is fixedly coupled to the top mounting plate 160. The magazine 170 is rotatably disposed within the housing 172, and defines a substantially cylindrical shape with a plurality of half-circle cutouts 174 (e.g., twelve cutouts) radially disposed at equal increments along the perimeter of the magazine 170. The cutouts 174 are configured and dimensioned to receive individual cucumbers 108 and maintain the cucumbers 108 in a substantially vertical orientation (e.g., parallel to a vertical rotation axis 176 of the magazine 170) between the half-circle cutouts 174 of the magazine 170 and the inner surface of the housing 172.

The diameter 178 of the magazine 170 is dimensioned smaller than the diameter 180 of the housing 172, thereby leaving sufficient space between the cutouts 174 and the inner surface of the housing 172 to receive the cucumbers 108. In some embodiments, the diameters 178, 180 are selected such that a cucumber 108 positioned within a cutout 174 abuts the cutout 174 on one lateral side and abuts the inner surface of the housing 172 on the opposing lateral side to ensure that the position of the cucumber 108 is maintained within the indexing station 104 (see, e.g., FIG. 4).

One or more components of the indexing station 104, e.g., the magazine 170, are rotatably coupled to the top mounting plate 160. The apparatus 100 includes drive means in the form of a motor 166 (e.g., a cucumber index servo motor or stepper motor) mounted to the mounting plate 158. A shaft 168 extends from the motor 166 through the mounting plates 158, 160 and is coupled to the magazine 170 of the indexing station 104. The motor 166 drives rotation of the shaft 168 which, in turn, rotates the magazine 170 relative to the top mounting plate 160.

The indexing station 104 additionally includes an infeed chute 182 mounted to one side of the housing 172. The infeed chute 182 defines a loading section of the indexing station 104. The infeed chute 182 can be tapered to urge cucumbers 108 into the housing 172. The housing 172 can include a corresponding radial cutout 184 formed therein such that a cucumber 108 placed into the infeed chute 182 slides through the cutout 184 in the housing 172 and into an empty cutout 174 of the magazine 170. The motor 166 can rotate or index the platform 172 such that empty cutouts 174 are positioned adjacent to the infeed chute 182 for loading of additional cucumbers 108 into the indexing station 104. In some embodiments, the cucumbers 108 can be loaded into the infeed chute 182 manually and/or by an automated process.

In some embodiments, the indexing station 104 can include a top cover 186 defining a substantially mushroom shape, with the top cover 186 covering a central portion of the indexing station 104 and a partial radial portion of the magazine 170. In particular, the top cover 186 can be shaped such that one radial portion of the magazine 170 (e.g., approximately 180°-250°) is exposed to provide visibility of the cucumbers 108 loaded into the indexing station 104, while the remaining radial portion of the magazine 170 is covered for safety purposes in the area where the cucumbers 108 are sliced. In some embodiments, the top cover 186 can be transparent and covers the entire indexing station 104 (except for the infeed chute 182), such that both visibility of the loaded cucumbers 108 and safety in the slicing area is provided.

In some embodiments, the housing 172 includes a bottom surface along which the cucumbers 108 move as the magazine 170 is rotated. In some embodiments, the top mounting plate 160 acts as the bottom surface for the housing 172 and the cucumbers 108 move along the top mounting plate 160 in a radial motion as the magazine 170 is rotated. Under the front-most radial position of the magazine 170, the top mounting plate 160 includes a circular opening 188 extending therethrough. The opening 188 is positioned such that the cucumber 108 in the magazine 170 above the opening 188 is aligned with a guide 190. The guide 190 is shown schematically (see, e.g., FIGS. 2 and 3) and can extend between the top mounting plate 160 and the filling station 106. The guide 190 can function to guide cut cucumber spears 120 into a cartridge 110, but can also be configured to center a cucumber 108 prior to cutting. In some embodiments, the guide 190 can be placed between the top mounting plate 160 and the indexing station 104. In some aspects, the top mounting plate 160 and/or the guide 190 can be a part of the indexing station 104.

The apparatus 100 also includes a static blade 192 (see, e.g., FIG. 1) that can be positioned within the guide 190 or the top mounting plate 160. The static blade 192 can also be a part of the indexing station 104. The blade 192 defines a substantially cross-shaped configuration such that it can cut a cucumber 108 into four equal-sized spears 120. The indexing station 104 includes a first actuator 194 disposed and aligned above the housing 172 at a position corresponding with the opening 188. In some embodiments, the actuator 194 can be in the form of an air cylinder including an extendable arm 196. Upon rotation of the magazine 170 such that a cucumber 108 is positioned over the opening 188, the actuator 194 can extend the arm 196 downwardly (e.g., toward the top mounting plate 160). Notably, rather than continuous rotation, the magazine 170 is indexed into corresponding positions by predetermined angles to sequentially position the cucumbers 108 over the opening 188.

Extension of the arm 196 imparts a downward force on the cucumber 108 disposed over the opening 188, pushing the cucumber 108 into the guide 190 and through the blade 192. Passage of the cucumber 108 through the cross-shaped blade 192 slices the cucumber 108 into four individual spears 120 to be placed in the central open space 118 of the jars 114. Although shown as an air cylinder, it should be understood that any type of hydraulic, electrical, and/or mechanical actuator can be used to urge the cucumber 108 through the guide 190 and the blade 192. For clarity, components associated with the actuator 194 (e.g., sensors, controller, valve(s), compressed air lines, solenoid vales, or the like) are not shown.

Figure 5:
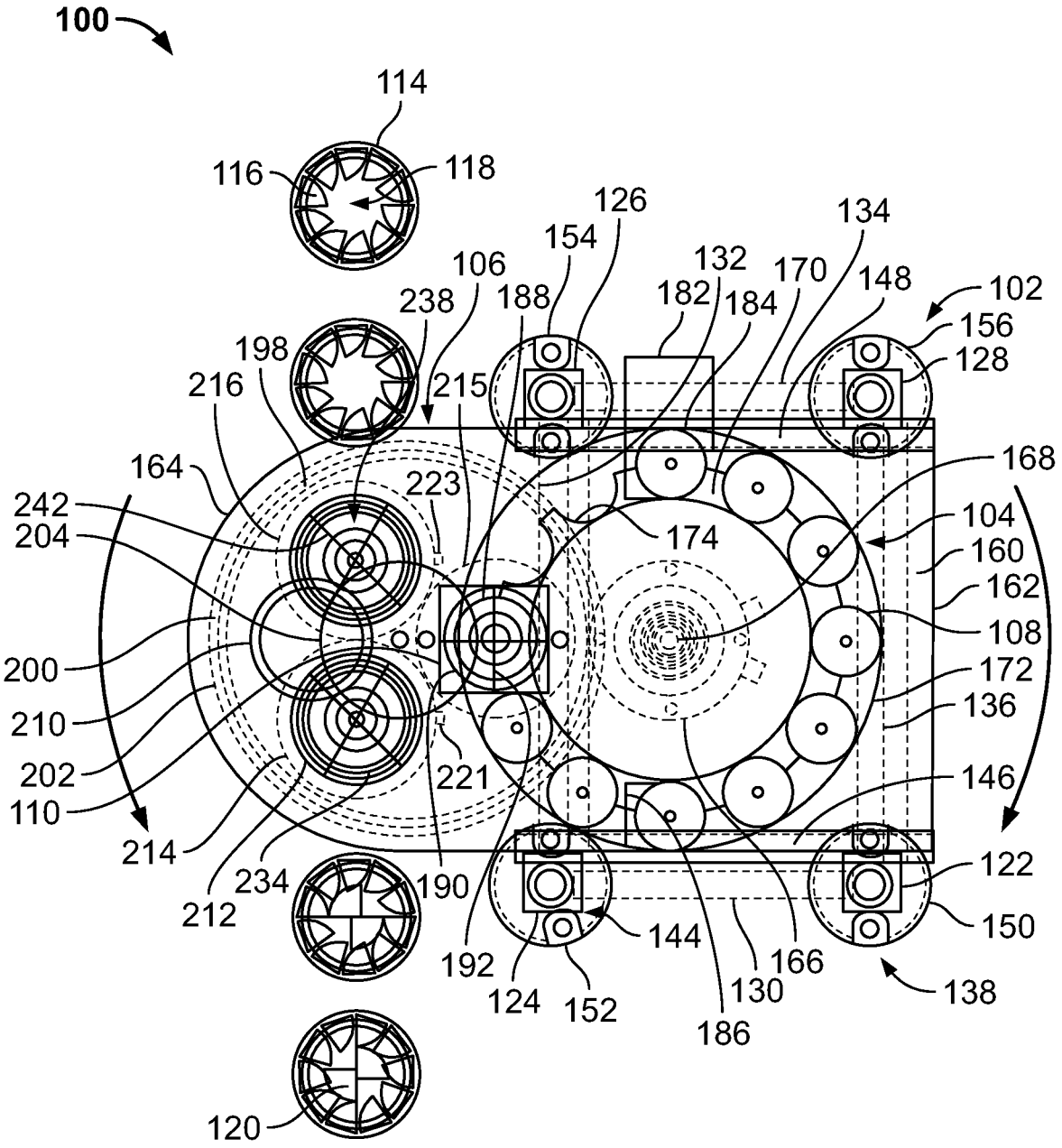
FIG. 5 is a detailed top view of a cucumber indexing station and a filling station of the spear center filler apparatus of FIG. 1.

The filling station 106 includes a top platform 198 and a bottom platform 200 mounted on opposing sides of the cartridges 110. Although shown as including three cartridges 110 radially spaced between the top and bottom platforms 198, 200, in some embodiments two or more cartridges 110 can be implemented. The assembly of the top platform 198 and cartridges 110 can be rotatably disposed within a substantially cylindrical housing 202. The apparatus 100 includes drive means in the form of a motor 204 (e.g., a spear index servo motor) disposed over the filling station 106, with a shaft 206 extending from the motor 204 and coupled to the top and/or bottom platforms 198, 200. In some embodiments, as shown in FIG. 5, the magazine 170 and the cartridges 110 can be rotated in opposing directions.

In some embodiments, a single motor (e.g., either motor 166 or motor 204) can be used to drive rotation of components of both the indexing station 104 and the filling station 106, with mechanical linkages coupling the components for the desired indexing. The motor 204 drives rotation of the shaft 206 which, in turn, drives rotation of the top platform 198 and the cartridges 110 about a vertical axis 208. Rather than continuous rotation, the cartridges 110 are indexed into corresponding positions by predetermined angles either to receive the cut cucumber 108 or above a jar 114 for loading the spears 120 into the jar 114. The axis 208 is substantially parallel to the axis 176, while being laterally spaced from the axis 176.

In some embodiments, the top mounting plate 160 can include an opening 210 spaced from the opening 188 and disposed near the front end of the top mounting plate 160. The top platform 198 includes individual openings 212 formed therein and disposed over each of the cartridges 110. As each cartridge 110 is rotated about the axis 208 and positioned below the guide 190, spears 120 (e.g., four spears) from the sliced cucumbers 108 drop through the opening 212 and into the cartridge 110 where they are secured. The bottom platform 200 includes first and second spear discharge openings 214, 216 that align with the position of the remaining cartridges 110 that are not disposed below the guide 190. Particularly, the spear openings 214, 216 are spaced and linearly aligned relative to each other, and are further aligned with two jars 114 disposed below the filling station 106. The station of the bottom platform 200 below the guide 190 can include a third spear discharge opening 215 that is aligned with the position of the cartridge 110 disposed below the guide 190, or can be free of openings to prevent undesired discharge of the spears from the cartridge 110.

The apparatus 100 also includes second and third actuators 218, 220 with second and third extendable arms 222, 224 disposed over the filling station 106 and extending through the top mounting plate 160. The second and third extendable arms 222, 224 are aligned over the spear discharge openings 214, 216 and can be extended through the openings 212. In some embodiments, the actuators 218, 220 can be air cylinders or any other hydraulic, electrical and/or mechanical actuators capable of selectively extending and retracting the second and third extendable arms 222, 224.

Upon positioning of the cartridges 110 holding spears above the spear discharge openings 214, 216, the actuators 218, 220 can be individually, sequentially, or simultaneously driven to extend the second and third extendable arms 222, 224 through the openings 212 and into the respective cartridge 110. Extending the second and third extendable arms 222, 224 into the cartridges 110 forces two spears 120 from each cartridge 110, through the respective spear discharge opening 214, 216, and into the central open space 118 of the jars 114 disposed below the filling station 106. The apparatus also includes first and second sensors 221, 223 that can be respectively positioned adjacent the first and second spear discharge openings 214, 216 in the bottom platform 200. The sensors 221, 223 are positioned and configured to determine if the central open space 118 in the jars 114 adjacent the spear discharge openings 214, 216 is obstructed or clear for the insertion of spears 120. If the first sensor 221 determines that there the jar 114 adjacent the first spear discharge opening 214 does not have space, e.g., there is an obstruction, then the first actuator 218 will not be actuated and the second extendable arm 222 will not be extended, thus leaving the spears 120 in the cartridge 110 that would have otherwise been discharged. Similarly, if the second sensor 223 determines that the jar 114 adjacent the second spear discharge opening 216 does not have space, e.g., there is an obstruction, then the second actuator 220 will not be actuated and the third extendable arm 224 will not be extended, thus leaving the spears 120 in the cartridge 110 that would have otherwise been discharged. If spears 120 are left remaining in the cartridge 110 after it is indexed passed the second spear discharge opening 216 and positioned adjacent the guide 190, then those remaining spears 120 will be forced out of the cartridge 110 and through the third spear discharge opening 215 by new spears 120 that are created from a new cucumber 108 forced through the guide 190 and blade 192 by the arm 192. The spears 120 that are forced through the third opening 215 can be collected in a bucket and reused to fill gaps in the jars 114. Alternatively, the apparatus 100 can include a fourth actuator 225, e.g., an air cylinder operated plunger, that can be positioned and configured to extend through the top mounting plate 160 to force any remaining spears 120 out of the cartridge 110 and into a collection bucket or other receptacle for use by manual jar fillers. In such a configuration, the filling station 106 can include five indexing positions instead of the three positions shown in FIG. 5, and thus can include five containers 110 instead of three. Accordingly, each of the five containers 110 of the filling station 106 can be indexed through five different positions that are equidistantly spaced (e.g., spaced by 72°), namely: a first position where a cucumber is received from the indexing station 104, cut, and loaded into a container 110, a second idle position where no action is taken upon the container 110, a third discharge position where two of the spears 120 are forced out from the cartridge 110 and into the central open space 118 of a first jar 114, a fourth discharge position where the two remaining spears 120 are forced out from the cartridge 110 and into the central open space 118 of a second jar 114, and a fifth discharge position where any remaining spears 120 that were not discharged from the cartridge 110 in either of the third discharge position or the fourth discharge position are forced out from the cartridge 110 by the fourth actuator 225 and into a bucket or other receptacle to be reused to fill gaps in the jars 114.

Drive means in the form of a motor 226 (e.g., a servo motor) and shaft 228 can drive rotation of the helical indexer 112 to transfer or move the jars 114 along a platform (not shown) such that subsequent jars 114 can be filled by the filling station 106. A guiding wall 230 can maintain the aligned position of the jars 114 as the jars 114 are moved by the helical indexer 112. In some embodiments, rather than or in addition to the helical indexer 112, a finger chain, an indexable conveyor, a walking conveyor, or a conveyor belt can be used.

Figure 6:
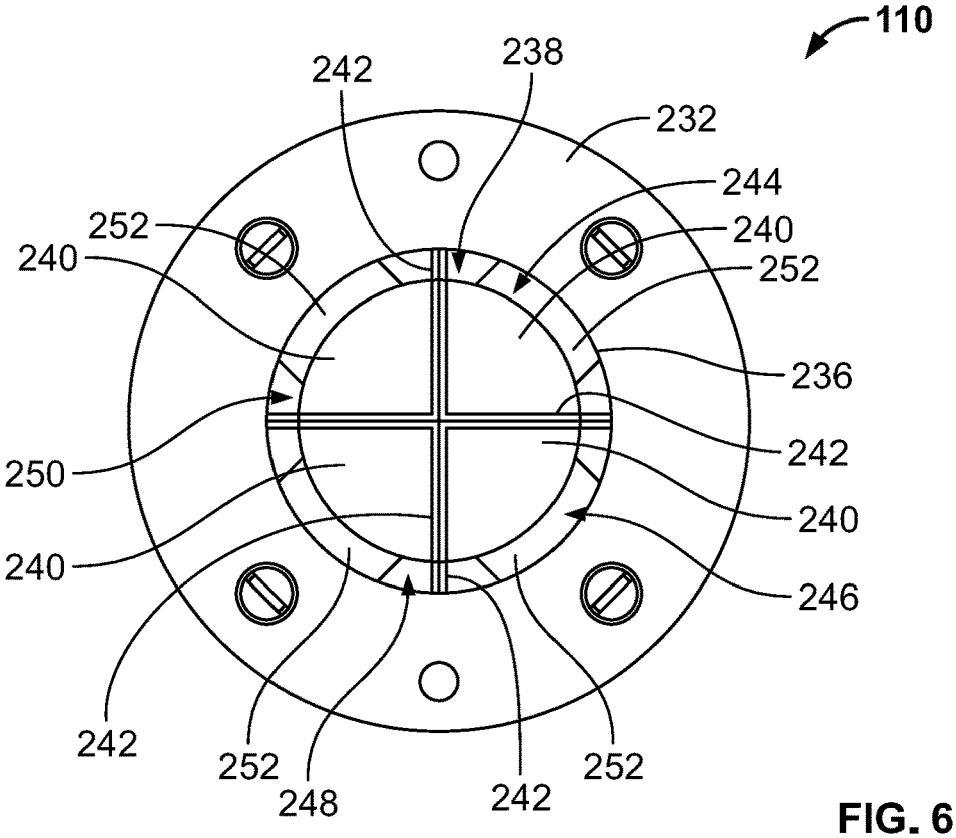
FIG. 6 is a top view of a cartridge in the filling station of the spear center filler apparatus of FIG. 1.
Figure 7:
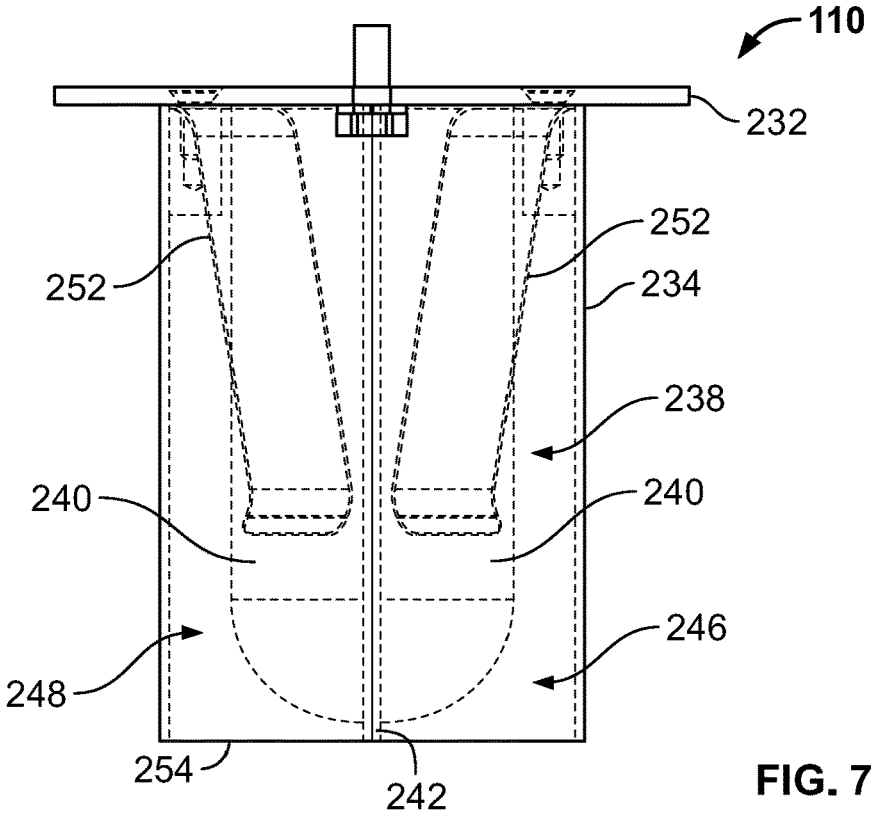
FIG. 7 is a side elevational view of the cartridge of FIG. 6.

FIGS. 6 and 7 show top and side views of the cartridge 110. Each cartridge 110 includes a top flange 232 mounted to a cylindrical or rectangular housing 234. The flange 232 includes a central opening 236. The flange 232 can be used to mount the cartridge 110 to the bottom surface of the top platform 198 such that the opening 236 aligns with the opening 212 in the platform 198. The housing 234 includes an inner chamber 238 configured and dimensioned to receive therein the sliced spears 240 after passage of the cucumber 108 through the guide 190.

The cartridge 110 includes four L-shaped brackets or plates 242 disposed within the housing 234 and positioned against each other. The plates 242 separate the chamber 238 into four equally sized inner chambers 244, 246, 248, 250, e.g., a first inner chamber 244, a second inner chamber 246, a third inner chamber 248, and a fourth inner chamber 250. In some embodiments, rather than L-shaped plates 242, two crisscrossing plates or a single cross-shaped plate can be used. Each of the inner chambers 244, 246, 248, 250 includes a spring-biased keeper 252 that urges each individual spear 240 against the inner corner of the respective inner chamber 244, 246, 248, 250 (e.g., against the plates 242). The top end of the keepers 252 can be mounted to the inner surface of the top flange 232, while the opposing end of each keeper 252 is allowed to flex as needed to allow the spear 240 to drop into the respective inner chamber 244, 246, 248, 250 and maintain the spear 240 within the inner chamber 244, 246, 248, 250. Particularly, the keepers 252 maintain the spears 240 within the inner chambers 244, 246, 248, 250 and prevent undesired passage of the spear 240 through the opening 254 at the bottom of the housing 234. The spring-biased nature of the keepers 252 allows for automatic adjustment of the position of the keeper 252 to ensure proper pressure is maintained on spears 240 of different sizes.

Figure 8:
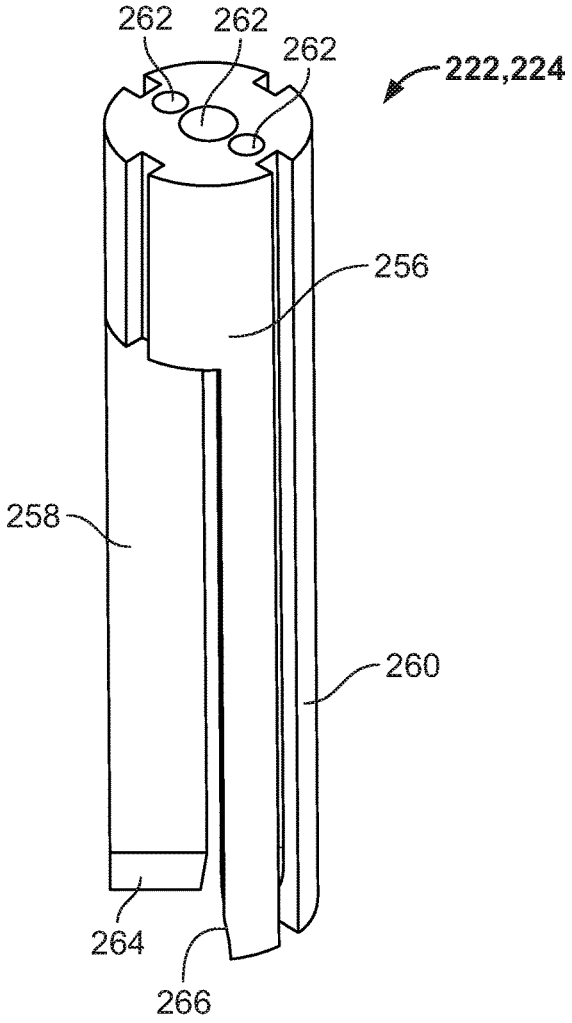
FIG. 8 is a top perspective view of an extendable arm of the present disclosure.
Figure 9:
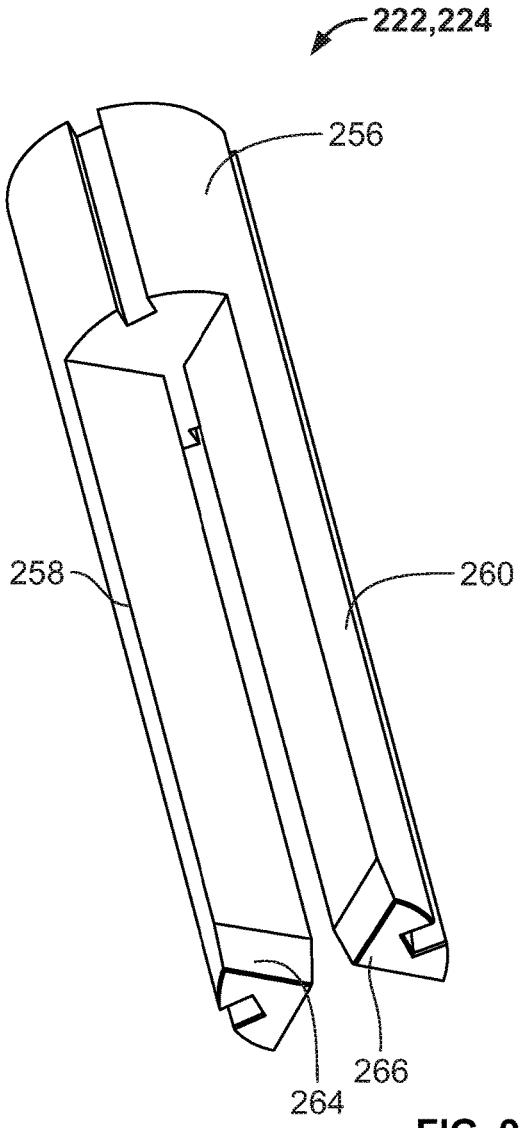
FIG. 9 is a bottom perspective views of the extendable arm of FIG. 8.
Figure 11:
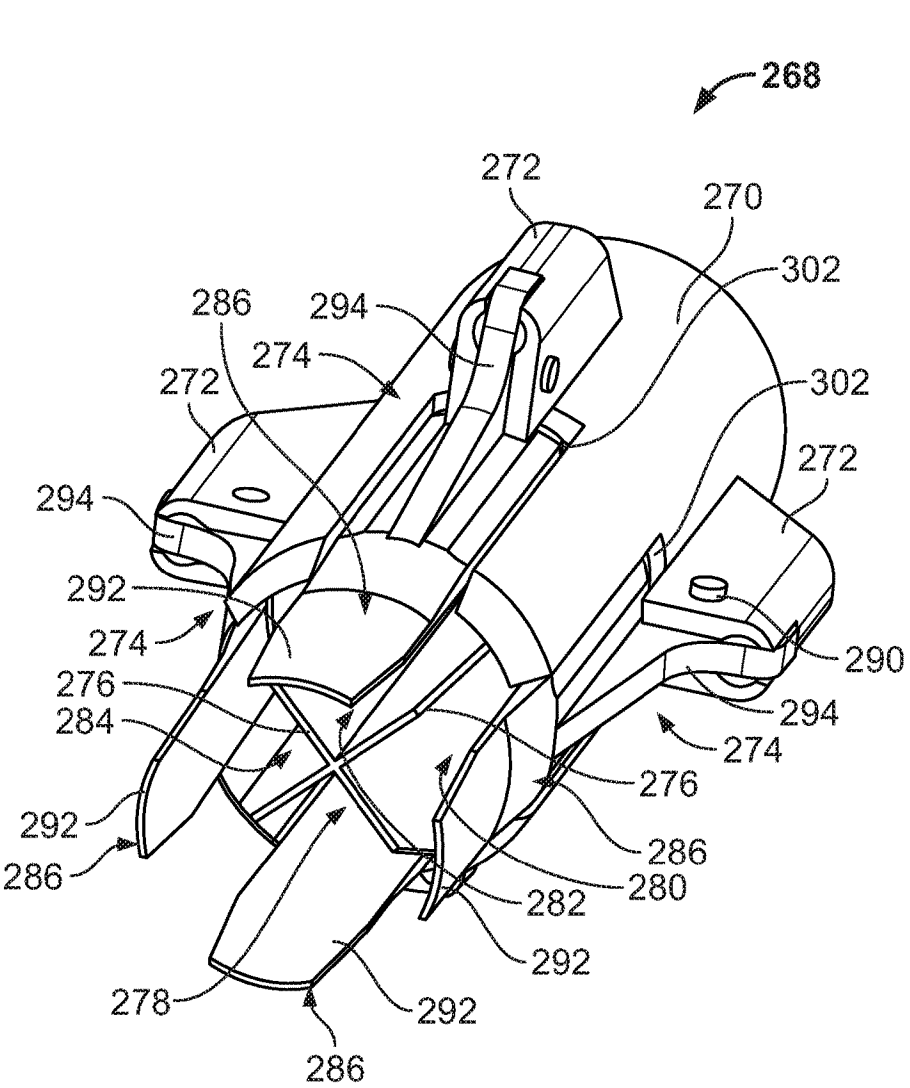
FIG. 11 is a bottom perspective view of the cartridge of FIG. 10.
Figure 10:
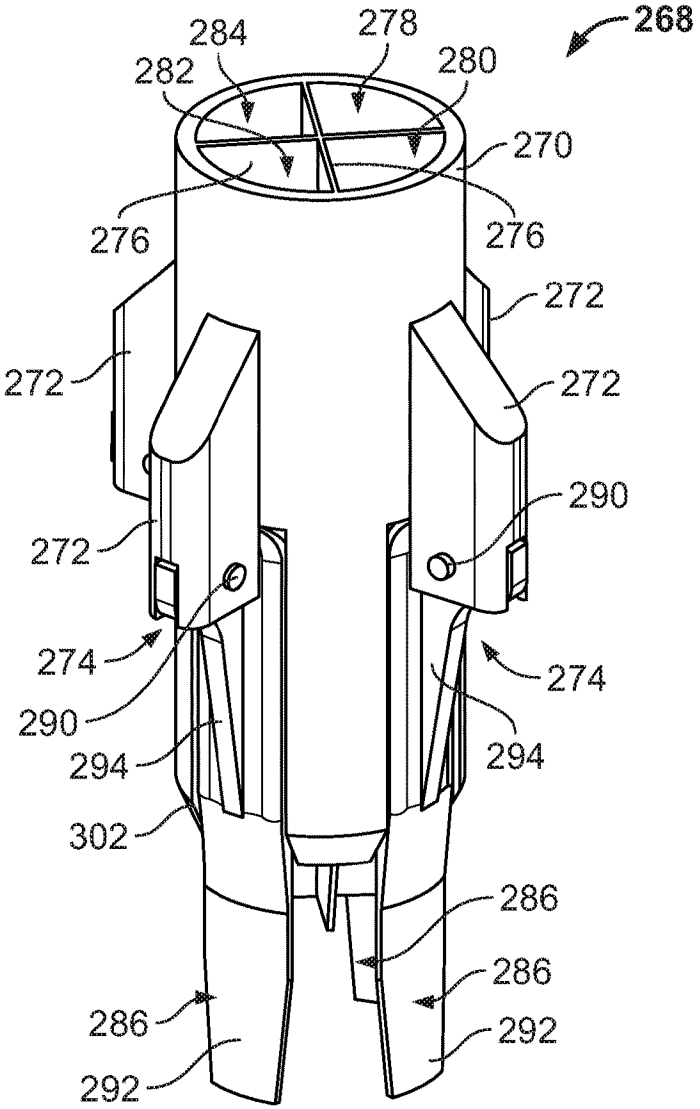
FIG. 10 is a top perspective view of a second embodiment of a cartridge according to the present disclosure.
Figure 13:
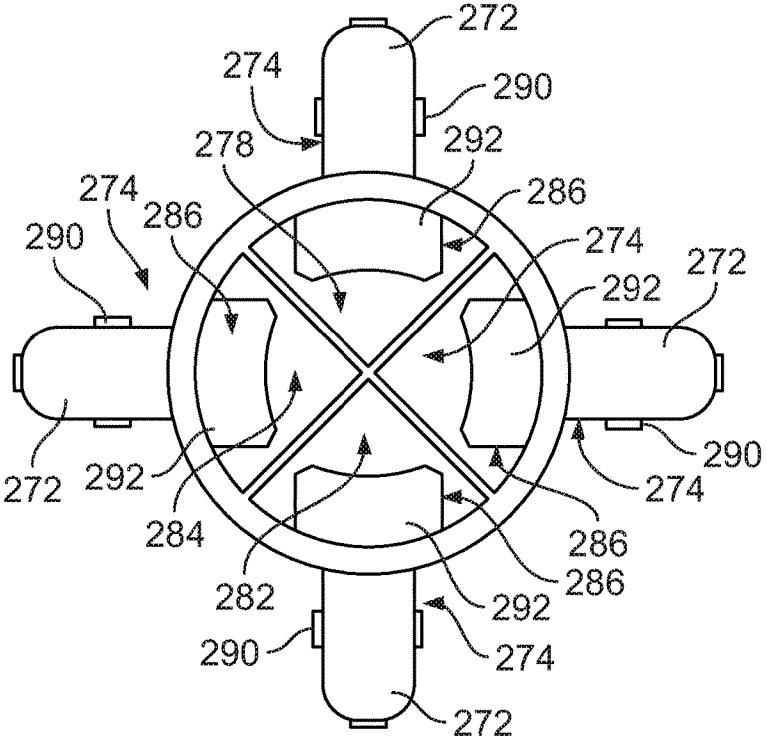
FIG. 13 is a top view of the cartridge of FIG. 10.
Figure 12:
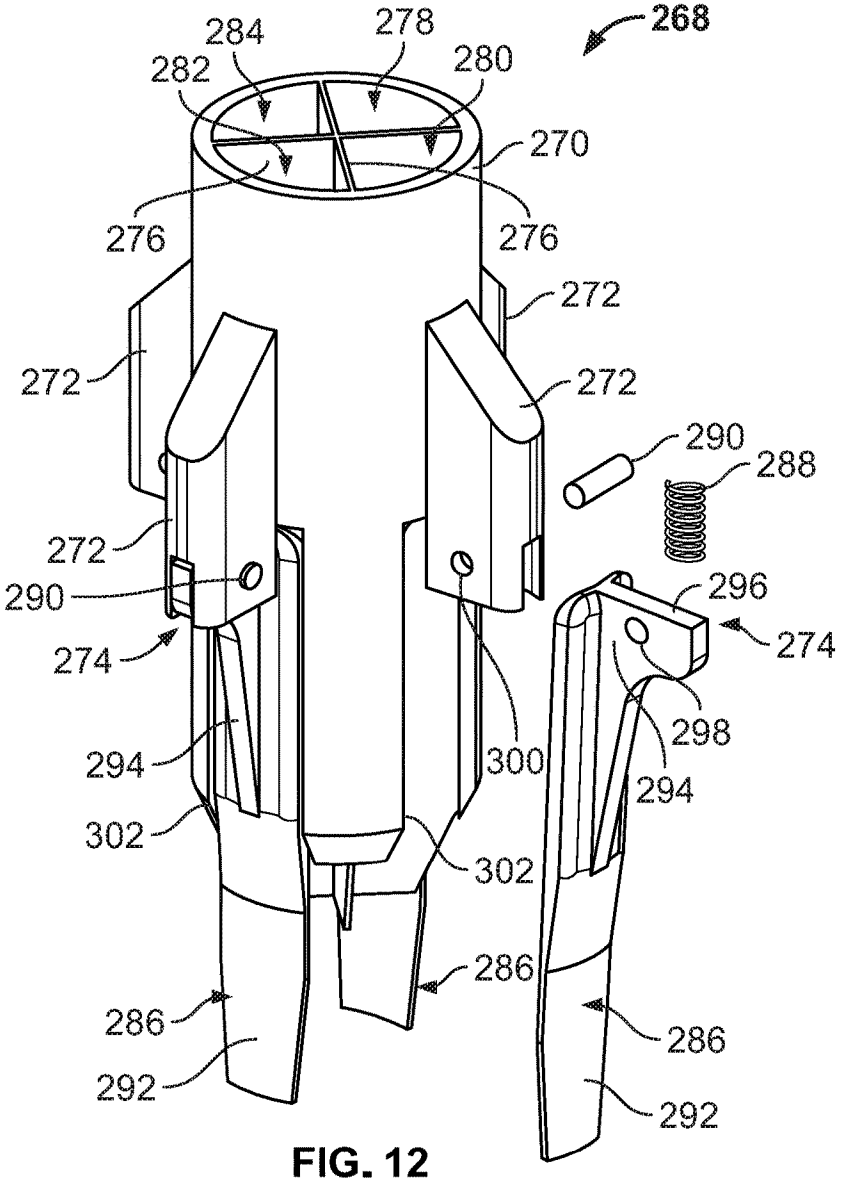
FIG. 12 is an exploded perspective view of the cartridge of FIG. 10.

FIGS. 8 and 9, are respectively top perspective and bottom perspective views of the first and second extendable arms 222, 224. The extendable arms 222, 224 are identical and include an upper cylindrical body 256 having first and second legs 258, 260 extending therefrom. The upper cylindrical body 256 includes mounting holes 262 that assist with mounting the extendable arms 222, 224 to the respective actuator 218, 220. The first and second legs 258, 260 of the extendable arms 222, 224 are generally shaped as quarter-circles and are configured to be inserted into the inner chambers 244, 246, 248, 250 of each cartridge 110. The first and second legs 258, 260 are generally diametrically opposed from one another such that there are two spaces between them.

Accordingly, when the first and second legs 258, 260 are inserted into a cartridge 110, the first and second legs 258, 260 will be inserted into diametrically opposed inner chambers 244, 246, 248, 250. For example, the first inner chamber 244 and the third inner chamber 248 would make-up a first pair of chambers, while the second inner chamber 246 and the fourth inner chamber 250 would make-up a second pair of chambers. Thus, if the first leg 258 is inserted into the first inner chamber 244 then the second leg 260 would be inserted into the third inner chamber 248, and if the first leg 258 is inserted into the second inner chamber 246 then the second leg 260 would be inserted into the fourth inner chamber 250. During operation, the first and second legs 258, 260 of the first extendable arm 222 are inserted into one of the pair of inner chambers, e.g., the first inner chamber 244 and the third inner chamber 248, while the first and second legs 258, 260 of the second extendable arm 222 are inserted into the second pair of inner chambers, e.g., the second inner chamber 246 and the fourth inner chamber 250. This configuration ensures that all four inner chambers 244, 246, 248, 250 are emptied of their spear 240. Additionally, the first and second legs 258, 260 can also include a chamfered end 264, 266 that assists with insertion of the first and second legs 258, 260 into the cartridge 110.

As noted above, in some embodiments, the bottom platform 200 includes spear discharge openings 214, 216 at positions above the jars 114 for filling the jars 114 with the spears through the openings 214, 216 by pressure imparted by the actuators 218, 220. In some embodiments, the bottom platform 200 can include multiple openings or be completely open. In both embodiments, the spring-biased keepers 252 maintain the spears 240 within the cartridge 110 until the actuators 218, 220 impart a force on one or more spears 240. The force from the actuators 218, 220 overcomes the spring force from the keepers 252.

During operation of the apparatus 100, the three actuators 194, 218, 220 will operate substantially simultaneously in order to cut a whole cucumber 108 into four spears 240 at the same time that two spears 240 are discharged from a cartridge 110 adjacent the first spear discharge opening 214 into a first jar 114 and two spears are discharged from a cartridge 110 adjacent the second spear discharge opening 216 into a second jar 114. That is, during each actuation, the following will occur: 1) the first actuator 194 extends its associated arm 196 downward imparting a downward force on a cucumber 108 held by the magazine 170 over the opening 188 in the top mounting plate 160, thus forcing the cucumber 108 through the guide 190 and the blade 192, cutting the cucumber 108 into a plurality of spears 120, and urging the spears 120 into a cartridge 110 that is adjacent the guide 190; 2) the second actuator 218 extends its associated extendable arm 222 through the aligned opening 212 in the top platform 198 and into the aligned cartridge 110 such that the first and second legs 258, 260 are inserted into opposing inner chambers 244, 246, 248, 250, e.g., the first inner chamber 244 and the third inner chamber 248, thus forcing two of the four spears 240 out of the cartridge 110, through the first spear discharge opening 214, and into the central open space 118 of a first jar 114 that is below the first spear discharge opening 214; and 3) the third actuator 220 extends its associated extendable arm 224 through the aligned opening 212 in the top platform 198 and into the aligned cartridge 110 such that the first and second legs 258, 260 are inserted into the opposing inner chambers 244, 246, 248, 250 that the first arm 222 was not inserted into, e.g., the second inner chamber 246 and the fourth inner chamber 250, thus forcing the two remaining spears 240 out of the cartridge 110, through the second spear discharge opening 216, and into the central open space 118 of a second jar 114 that is below the second spear discharge opening 216.

Thus, prior to each actuation the cartridge 110 adjacent the opening 188 in the top mounting plate 160 will generally contain no spears 240, the cartridge 110 adjacent the first spear discharge opening 214 will generally contain four spears 240, and the cartridge 110 adjacent the second spear discharge opening 216 will generally contain two spears 240. Of course, this is unless one of the sensors 221, 223 prevented one of the actuators 218, 220 from actuating in accordance with the above discussion. Additionally, one of ordinary skill in the art should understand that the number of spears contained in each cartridge 110 at each position may vary depending on the number of spears 240 that a cucumber 108 was cut into, and the number of inner chambers in each cartridge 110.

Further, after each actuation is complete the cartridge 110 adjacent the opening 188 in the top mounting plate 160 will generally contain four spears 240, the cartridge 110 adjacent the first spear discharge opening 214 will generally contain two spears 240, and the cartridge 110 adjacent the second spear discharge opening 216 will generally contain no spears 240. After each actuation is complete, the magazine 170 is indexed one step by the motor 166 to place a whole cucumber 108 adjacent the opening 188, the cartridges 110 are indexed one step by the motor 204 to place an empty cartridge 110 adjacent the opening 188, and the jars 114 are indexed two steps by the motor 226 and helical indexer 112 so that two new jars 114 having a central open space 118 are positioned adjacent the first and second spear discharge openings 214, 216.

In some embodiments, the bottom platform 200 can include a dead plate having multiple openings (instead of or in addition to the keepers 252). In such embodiments, when the cartridge 110 is rotated to a position over a jar 114, the dead plate exposes one or more of the spears 240 and allows the one or more spears 240 to fall out of the cartridge 110 and into the jar 114. For example, in one embodiment, the dead plate exposes two opposing spears 240 and, upon further rotation of the cartridge 110, the dead plate exposes the remaining two opposing spears 240. The dead plate thereby allows the opposing spears 240 to be sequentially dispensed from the cartridge 110 in pairs.

In some embodiments, the apparatus 100 is configured to place two opposing spears 240 (e.g., quarters) in a single jar 114 during each operation of the actuators 218, 220. In some embodiments, the apparatus 100 is configured to place two opposing spears 240 from two cartridges 110 into two adjacently positioned jars 114 during each operation of the actuators 218, 220. In some embodiments, the apparatus 100 is configured to place two adjacently disposed spears 240 into a jar 114. In some embodiments, the apparatus 100 is configured to place all four spears 240 from one cartridge 110 into a single jar 114 during each operation of the actuators 218, 220. In some embodiments, the filling station 106 is configured to place two opposing spears 240 from a cartridge 110 into a first jar 114, rotate or index the cartridge 110 to be positioned over a second jar 114, and places the remaining two opposing spears 240 from the cartridge 110 into the second jar 114.

In some embodiments, the blade 192 can cut the cucumber 108 into more than four spears 240 and the cartridge 110 includes plates 242 that separate the chamber 238 into a corresponding number of individual chambers. In some embodiments, the filing station 106 can include an opening in the bottom platform 200 below the guide 190 such that the spears 240 can drop into a storage container for future manual insertion or disposal. In such embodiments, rather than dropping into a cartridge 110, the spears 240 can drop into the storage or waste container.

In some embodiments, rather than a storage or waste container, the apparatus 100 can include a conveyor belt that transfers the spears 240 to a different location or container. In some embodiments, the spears 240 of the first sliced cucumber 108 can be placed into a cartridge 110 and a second cucumber 108 can be sliced with the spears 240 being directed into the same cartridge 110. In such embodiments, the spears 240 from the second cucumber 108 push out the spears 240 of the first cucumber 108 from the cartridge 110, through an opening in the bottom platform 200 and into a storage or waste container.

Thus, in operation, whole cucumbers 108 are loaded into the housing 172 of the indexing station 104. The magazine 170 of the indexing station 104 is indexed incrementally to position a cucumber 108 over the guide 190. The actuator 194 is driven to push the cucumber 108 downwardly through the guide 190 and blade 192. As the cucumber 108 passes through the blade 192, the cucumber 108 is sliced into two or more spears 240. The spears 240 drop or are driven into a cartridge 110 of the filling station 106. The cartridge 110 is indexed incrementally to position the cartridge 110 over a jar 114. In one embodiment, an actuator 218 is driven to push two opposing spears 240 from the cartridge 110 and into the central open space 118 within the jar 114. The cartridge 110 is indexed further to be positioned over a second jar 114 and the actuator 220 is driven to push the two remaining opposing spears 240 from the cartridge 110 and into the central open space 118 within the second jar 114. Filling of the central open space 118 is thereby performed in an automated and efficient manner.

FIGS. 10-13 are respectively top perspective, bottom perspective, exploded, and top views of a second embodiment cartridge 268 that can be used in place of the cartridges 110 shown in FIGS. 6 and 7. The cartridge 268 includes a cylindrical body 270, four mounts 272 extending radially from the cylindrical body 270, and four keeper assemblies 274 each secured to a respective mount 272. The cylindrical body 270 is generally open at the top and bottom and includes internal plates 276 that divide an internal chamber of the cylindrical body 270 into four equally sized inner chambers 278, 280, 282, 284, e.g., a first inner chamber 278, a second inner chamber 280, a third inner chamber 282, and a fourth inner chamber 284, configured and dimensioned to receive therein the sliced spears 240 after passage of the cucumber 108 through the guide 190 and blade 192.

Each of the inner chambers 278, 280, 282, 284 has a keeper assembly 274 associated therewith that urges each individual spear 240 against the inner corner of the respective inner chamber 278, 280, 282, 284 (e.g., against the plates 276). Specifically, each keeper assembly 274 includes a keeper arm 286, a spring 288, and a pin 290. The keeper arm 286 includes a spear contacting body 292 and a mounting flange 294 having an upper surface 296 and a hole 298 extending therethrough. Each keeper assembly 274 is secured to a mount 272 by the pin 290 which extends through a hole 300 of the mount 272 and the hole 298 of the keeper arm 286, thus allowing the keeper arm 286 to rotate about the pin 290. The spring 288 is secured between the upper surface 296 of the mounting flange 294 and the mount 272 such that it biases the spear contacting body 292 radially inward and through a respective removed section 302 in the cylindrical body 270 and into one of the inner chamber 278, 280, 282, 284. The cylindrical body 270 can also include four removed sections 302, one for each of the four keeper assemblies 274, which permit the spear contacting body 292 of each keeper assembly 274 to extend into the associated inner chamber 278, 280, 282, 284. The springs 288 allow each of the keeper arms 286 to flex outward as needed to allow the spear 240 to drop into the respective inner chamber 278, 280, 282, 284, but provides sufficient biasing force so that the keeper arms 286 maintain the spear 240 within the respective inner chamber 278, 280, 282, 284. Particularly, the keeper arms 286 maintain the spears 240 within the inner chambers 278, 280, 282, 284 and prevent undesired passage of the spear 240 through the cylindrical body 270. The spring-biased nature of the keeper arms 286 allows for automatic adjustment of the position of the keeper arms 286 to ensure proper pressure is maintained on spears 240 of different sizes. Additionally, the keeper arms 286 extend below the cylindrical body 270 such that they can be inserted into a jar 114 and assist with insertion of the spears 240 into the central open space 118 of the jar 114.

Figure 14:
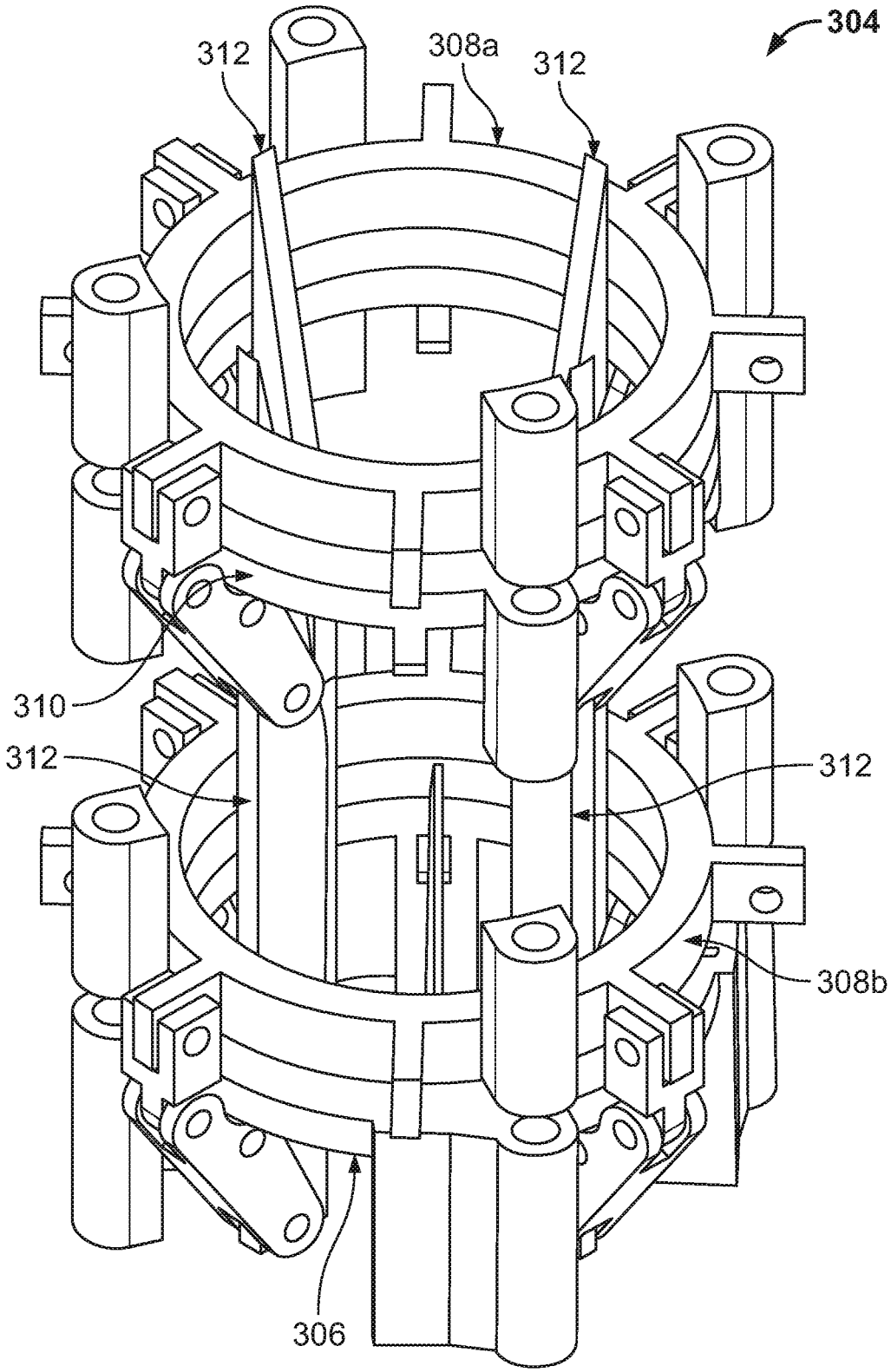
FIG. 14 is a top perspective view of a centering guide according to the present disclosure.
Figure 15:
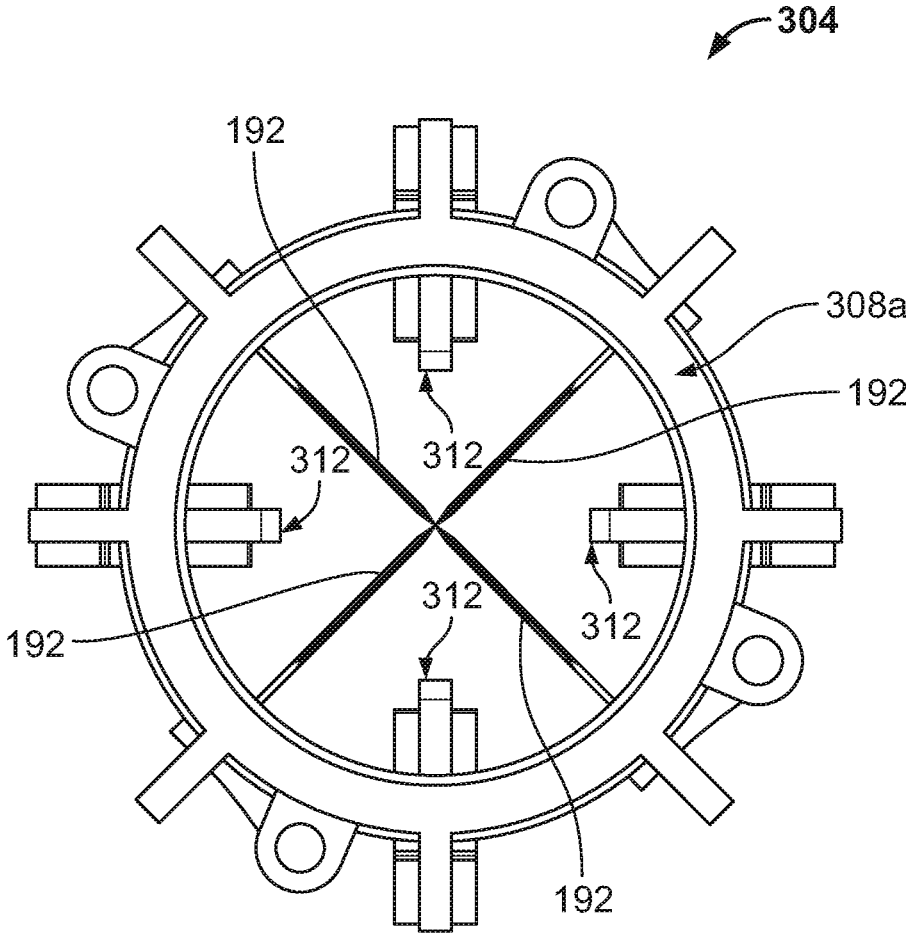
FIG. 15 is a top plan view of the centering guide of FIG. 14.

FIGS. 14 and 15 are respectively top perspective and top views of a centering guide 304 of the present disclosure that can be implemented with the apparatus 100 in place of the guide 190 or in addition to the guide 190. As shown in FIGS. 14 and 15, the centering guide 304 can include the blade 192, which can be integral with the centering guide 304.

Figure 16:
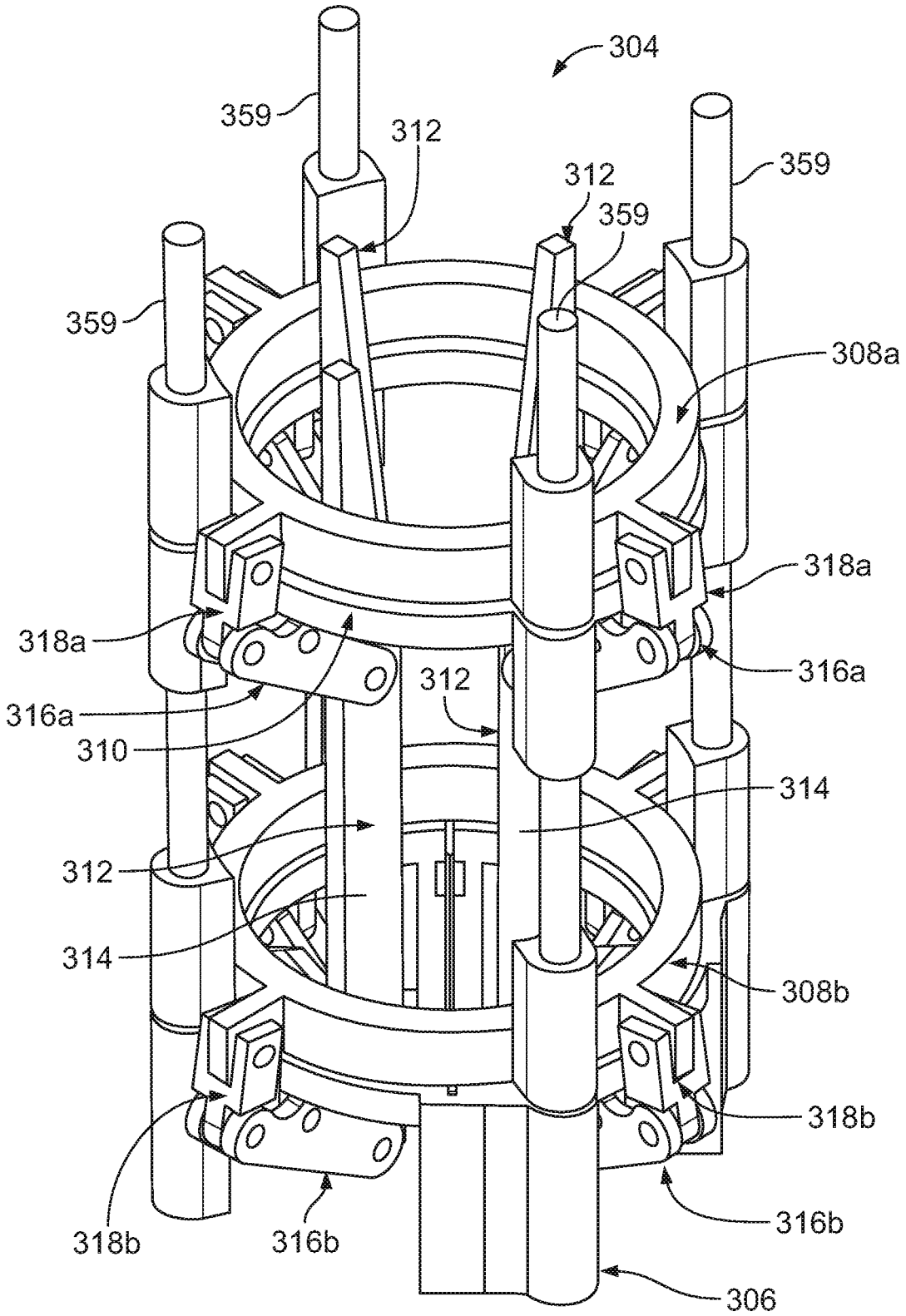
FIG. 16 is a perspective view of the centering guide of FIG. 14 in a closed position.
Figure 17:
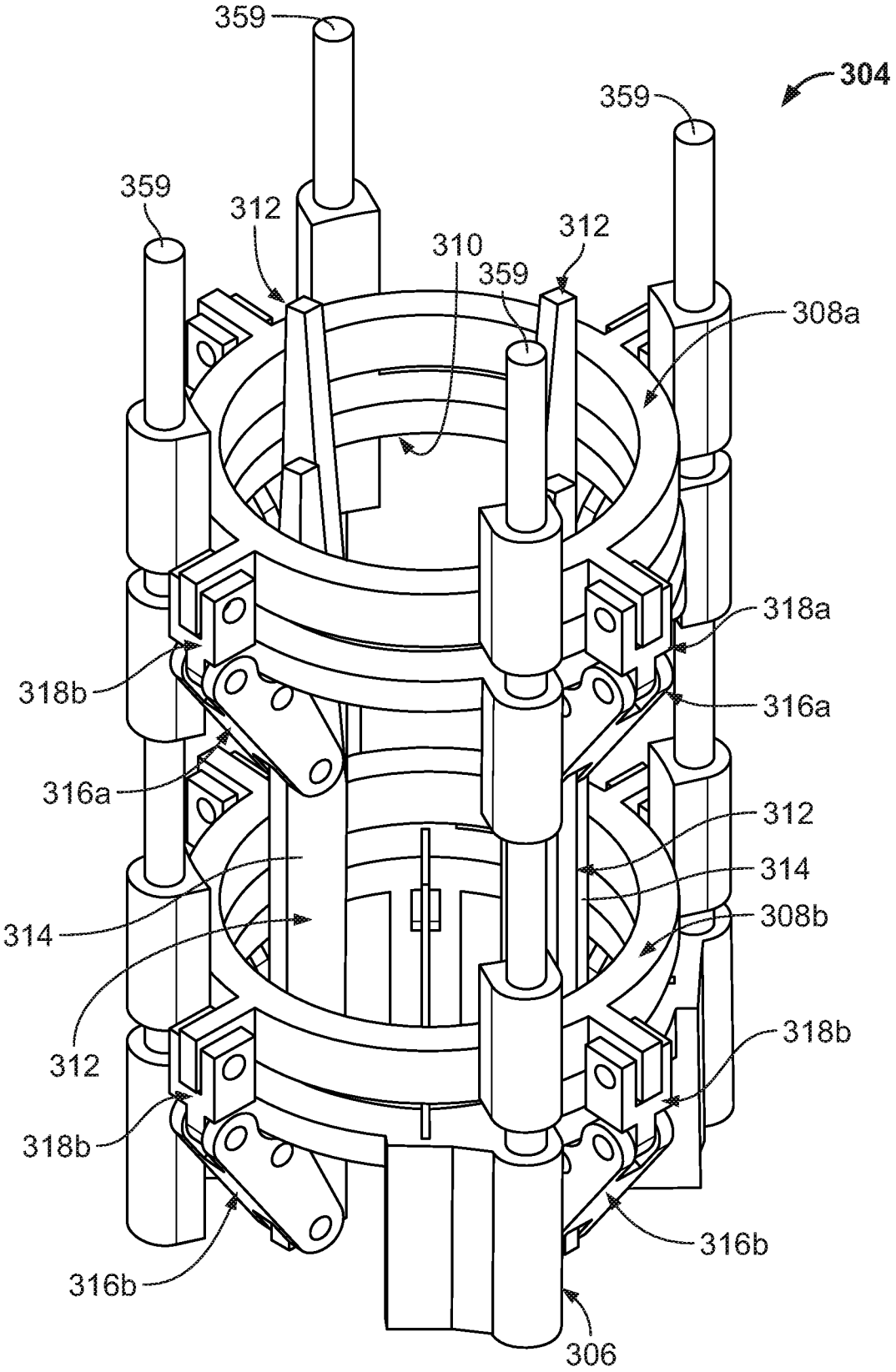
FIG. 17 is a perspective view of the centering guide of FIG. 14 in an open position.
Figure 18:
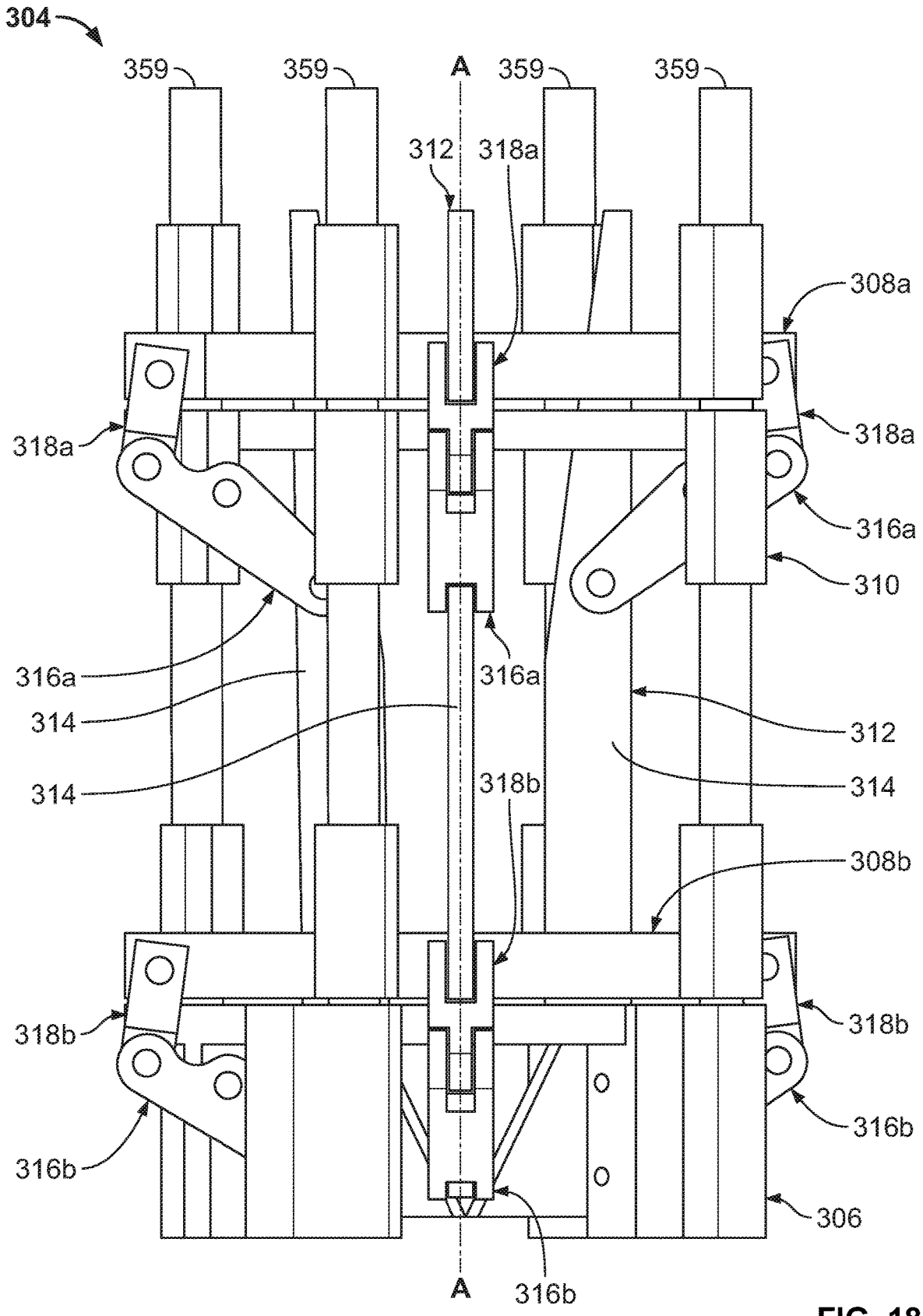
FIG. 18 is a side elevational view of the centering guide of FIG. 14 in the closed position.
Figure 19:
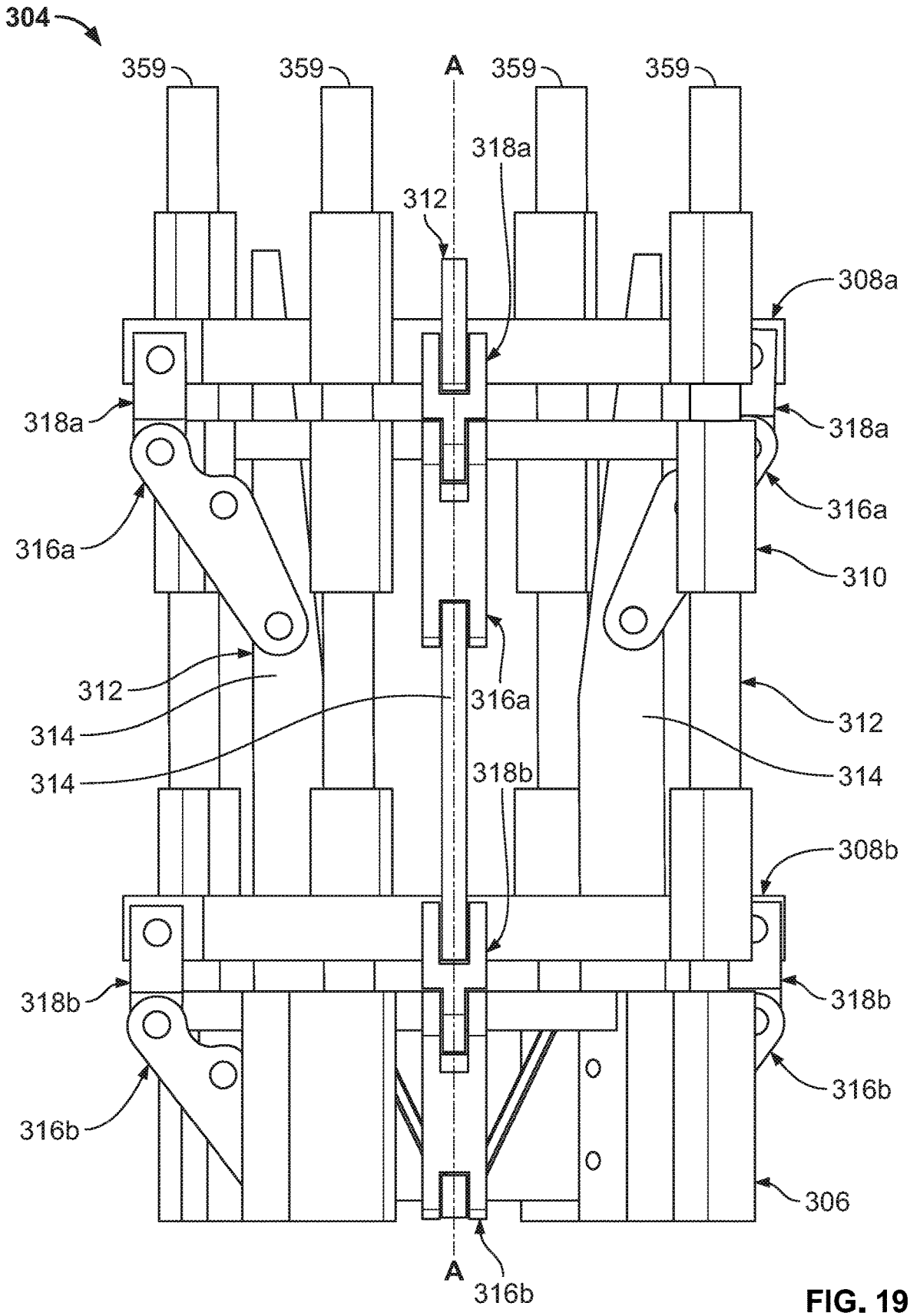
FIG. 19 is a side elevational view of the centering guide of FIG. 14 in the open position.
Figure 20:
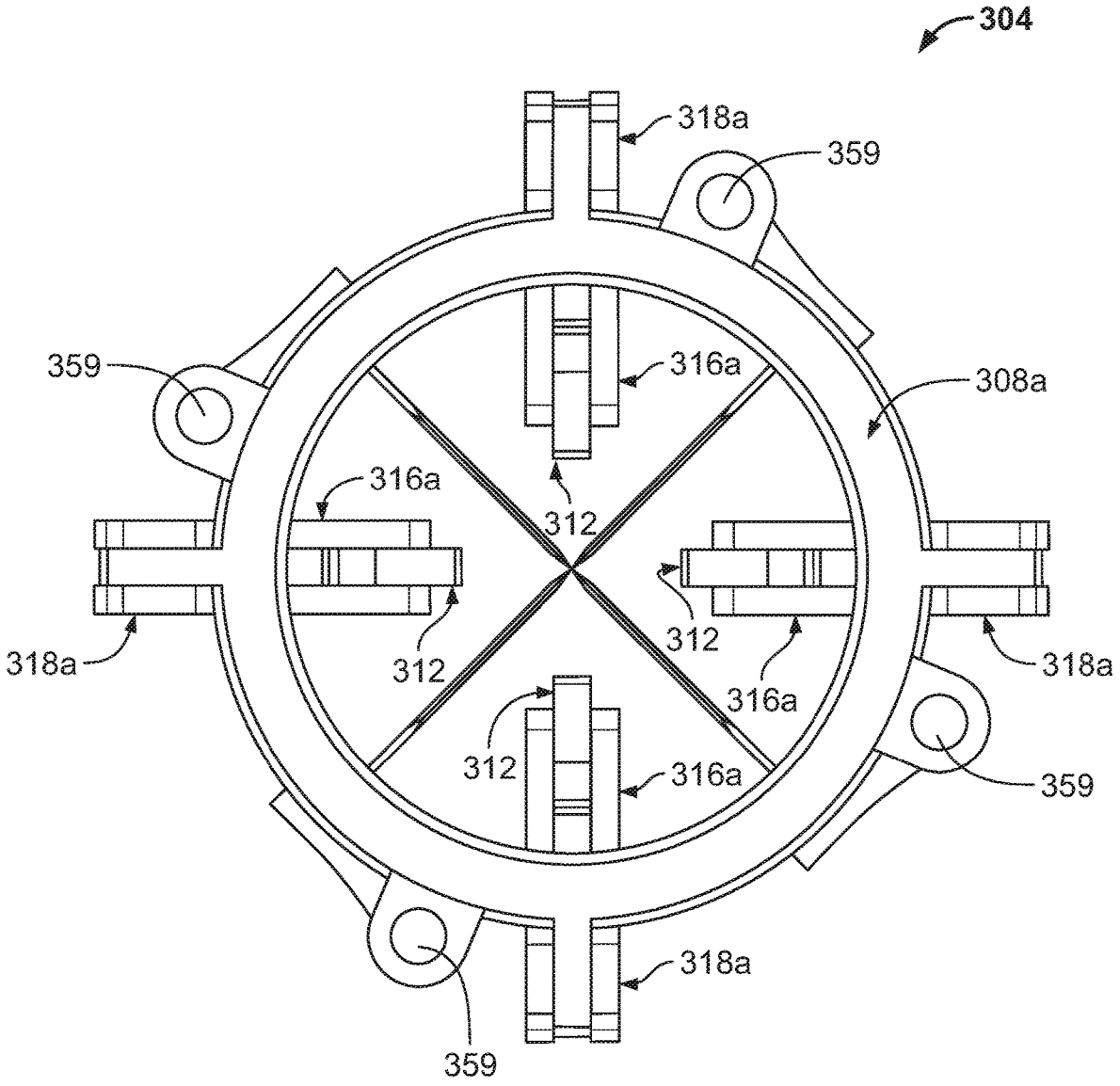
FIG. 20 is a top plan view of the centering guide of FIG. 14 in the closed position.
Figure 21:
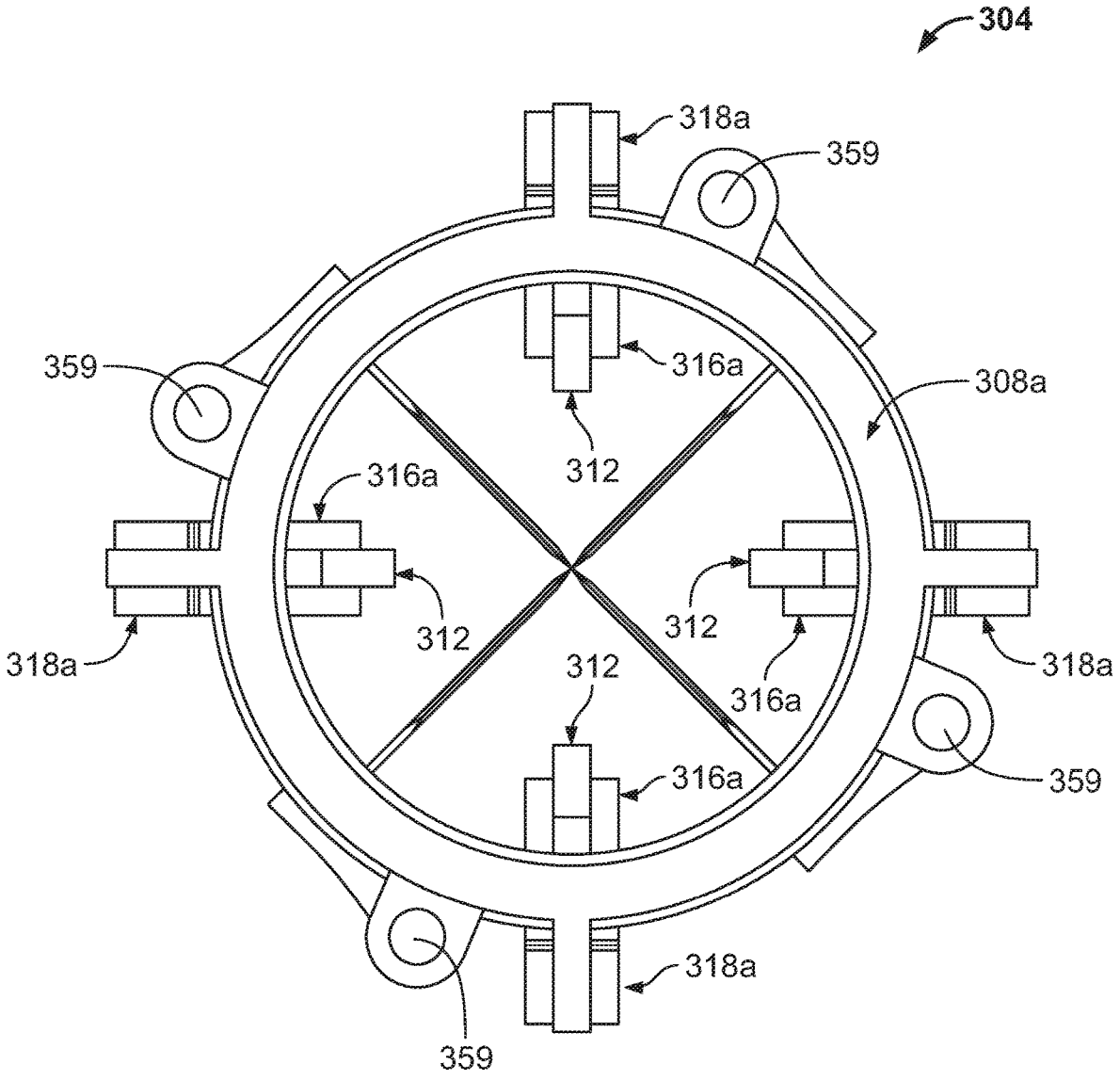
FIG. 21 is a top plan view of the centering guide of FIG. 14 in the open position.

FIGS. 16-26 show the centering guide 304 in greater detail. FIGS. 16 and 17 are perspective views of the centering guide 304 in a closed position and an open position, respectively. FIGS. 18 and 19 are side elevational views of the centering guide 304 in the closed position and the open position, respectively. FIGS. 20 and 21 are top plan views of the centering guide 304 in the closed position and the open position, respectively. The centering guide 304 generally includes a blade mount ring 306, first and second outer rings 308*a*, 308*b*, a pivot mount ring 310, a plurality of guide rail subassemblies 312, and a central axis A.

Figure 22:
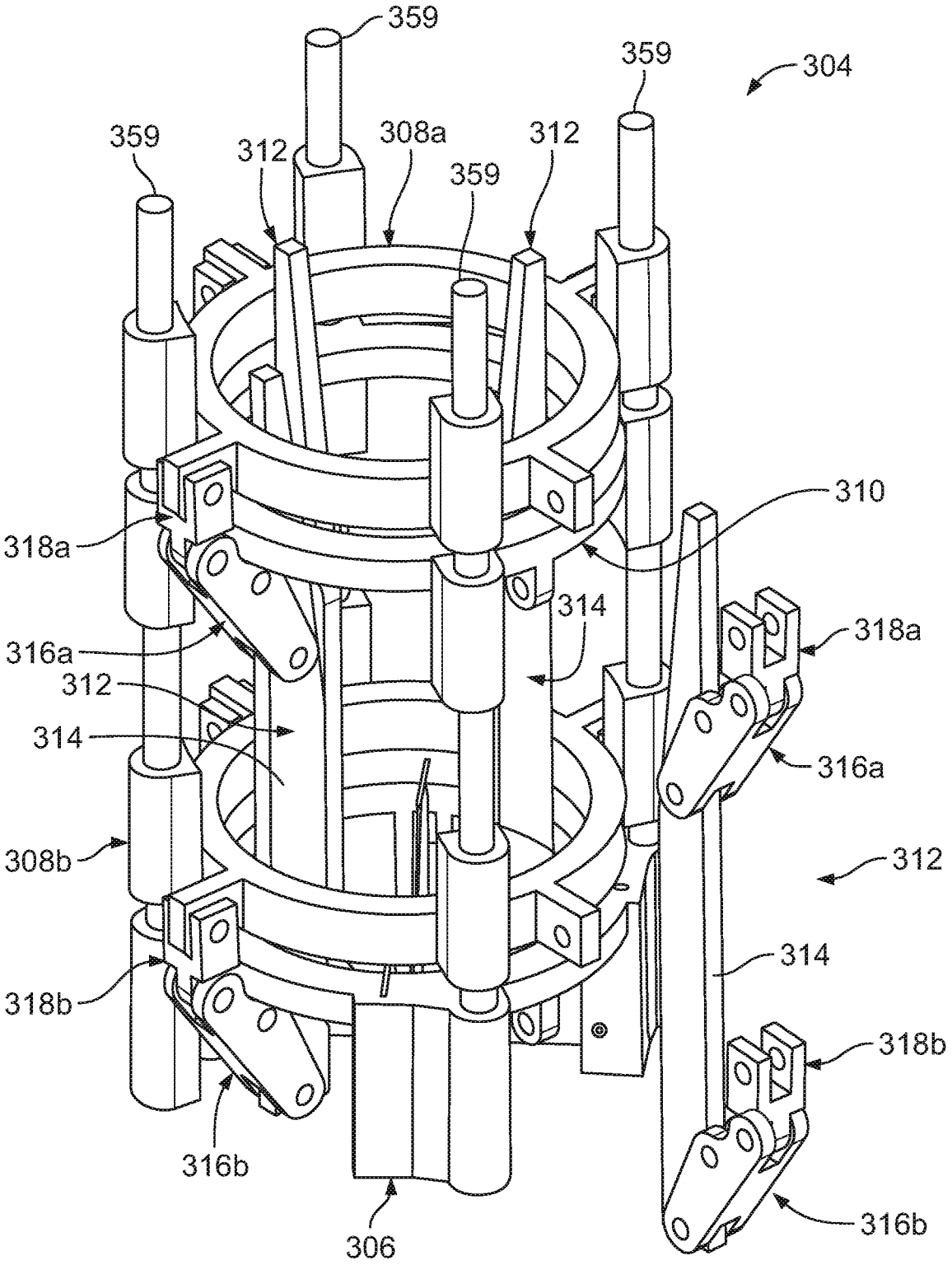
FIG. 22 is a partially exploded perspective view of the centering guide of FIG. 14.

FIG. 22 is a partially exploded perspective view of the centering guide 304 showing one of the plurality of guide rail subassemblies 312 exploded. All of the guide rail subassemblies 312 can be identical in constructions. Accordingly, it should be understood that the description of one guide rail subassembly 312 holds true for all of the guide rail subassemblies 312. Each of the guide rail subassemblies 312 is configured to be rotatably mounted to the blade mount ring 306, the first and second outer rings 308*a*, 308*b*, and the pivot mount ring 310. Each of the guide rail subassemblies 312 includes a guide rail 314, first and second pivot linkages 316*a*, 316*b*, and first and second forked linkages 318*a*, 318*b*. The first pivot linkage 316*a* and the first forked linkage 318*a* can form a first linkage subassembly, while the second pivot linkage 316*b* and the second forked linkage 318*b* can form a second linkage subassembly.

Figure 23:
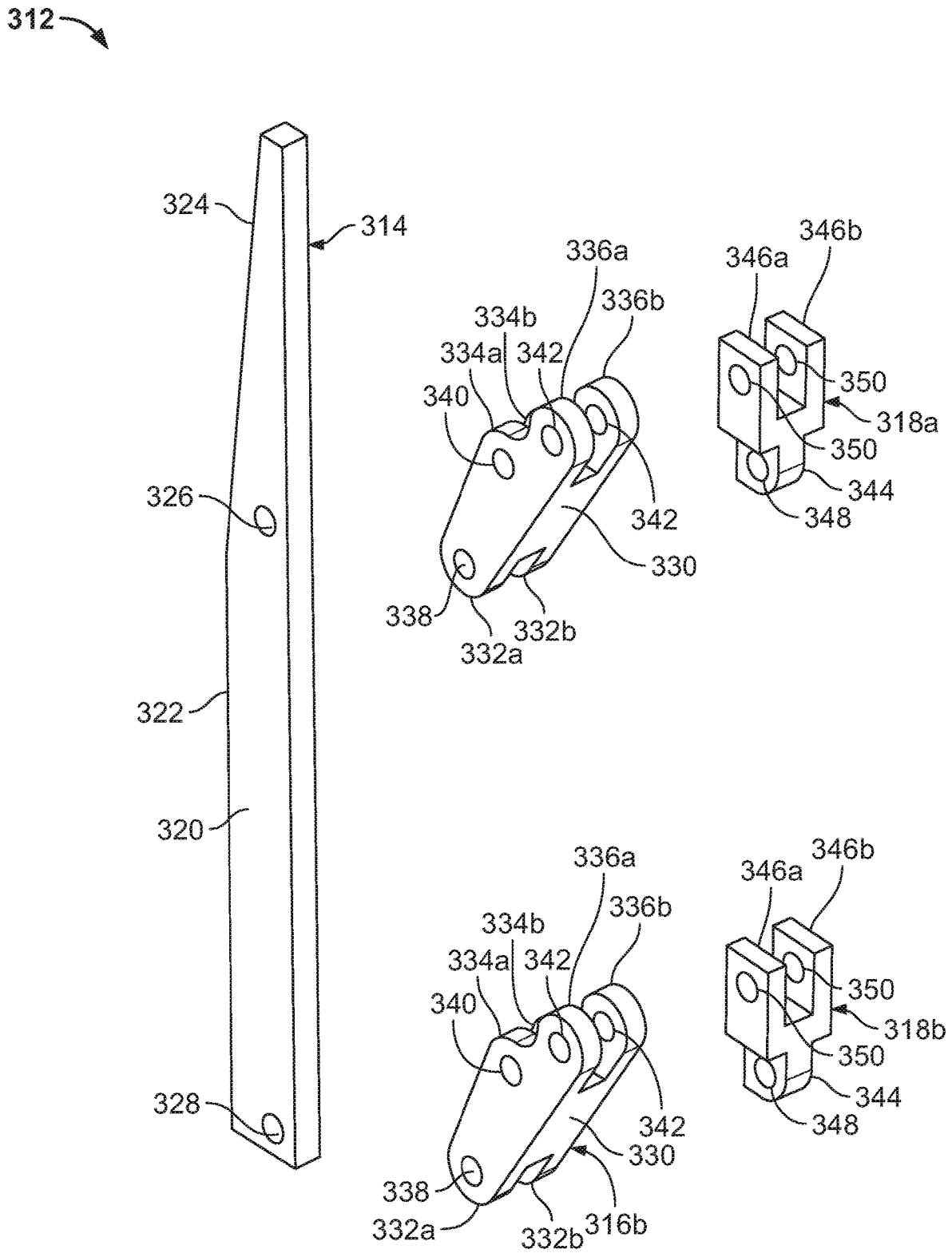
FIG. 23 is an exploded perspective view of a guide rail assembly of the centering guide of FIG. 14.

FIG. 23 is an exploded perspective view of a guide rail subassembly 312. The guide rail 314 includes a body 320 having a substantially vertical face 322, a tapered face 324, a first hole 326, and a second hole 328. The tapered face 324 can be positioned at a top portion of the body 320 and taper inward toward the substantially vertical face 322 so that the width of the body 320 increases as it approaches the substantially vertical face 322. The width of the body 320 is substantially constant along the length of the substantially vertical face 322. The first and second holes 326, 328 can be spaced apart from each other and are configured to mount with the first and second pivot linkages 316*a*, 316*b*, respectively, e.g., via a pin. In this regard, the first and second pivot linkages 316*a*, 316*b* can be identical in construction and include a body 330, bottom legs 332*a*, 332*b*, intermediate mounts 334*a*, 334*b*, and top arms 336*a*, 336*b*. The bottom legs 332*a*, 332*b* are spaced apart and include a first pivot hole 338 extending therethrough. The intermediate mounts 334*a*, 334*b* are spaced apart and include a second pivot hole 340 extending therethrough. The top arms 336*a*, 336*b* are spaced apart and include a third pivot hole 342 extending therethrough. The first pivot linkage 316*a* is configured to be rotatably mounted to the guide rail 314, the pivot mount ring 310, and the first forked linkage 318*a*. The second pivot linkage 316*b* is configured to be rotatably mounted to the guide rail 314, the blade mount ring 306, and the second forked linkage 318*b*. Regarding the connection to the guide rail 314, the first pivot linkage 316*a* is configured to have the body 320 of the guide rail 314 positioned between the first and second legs 332*a*, 332*b* with the first pivot hole 338 aligned with the first hole 326 of the guide rail 314. A pin can be inserted through the first pivot hole 338 and the first hole 326 to permit rotation between the first pivot linkage 316*a* and the guide rail 314. Similarly, the second pivot linkage 316*b* is configured to have the body 320 of the guide rail 314 positioned between the first and second legs 332*a*, 332*b* with the first pivot hole 338 aligned with the second hole 328 of the guide rail 314. A pin can be inserted through the first pivot hole 338 and the second hole 328 to permit rotation between the second pivot linkage 316*b* and the guide rail 314.

The first and second forked linkages 318*a*, 318*b* can be identical in construction and include a body 344 and forked arms 346*a*, 346*b* extending from the body 344. The body 344 can include a through-hole 348, while the forked arms 346*a*, 346*b* can include a mounting hole 350 extending through both forked arms 346*a*, 346*b*. The first forked linkage 318*a* is configured to be rotatably mounted to the first pivot linkage 316*a* and the first outer ring 308*a*. Specifically, the body 344 of the first forked linkage 318*a* is configured to be placed between the top arms 335*a*, 335*b* of the first pivot linkage 316*a* with the through-hole 348 aligned with the third pivot hole 342 of the first and second top arms 336*a*, 336*b* of the first pivot linkage 316*a*. A pin can be inserted through the third pivot hole 342 and the through-hole 348 to permit rotation between the first pivot linkage 316*a* and the first forked linkage 318*a*. The second forked linkage 318*b* is configured to be rotatably mounted to the second pivot linkage 316*b* and the second outer ring 308*b*. Specifically, the body 344 of the second forked linkage 318*b* is configured to be placed between the top arms 336*a*, 336*b* of the second pivot linkage 316*b* with the through-hole 348 aligned with the third pivot hole 342 of the first and second top arms 336*a*, 336*b* of the second pivot linkage 316*b*. A pin can be inserted through the third pivot hole 342 and the through-hole 348 to permit rotation between the second pivot linkage 316*b* and the second forked linkage 318*b*.

Figure 24:
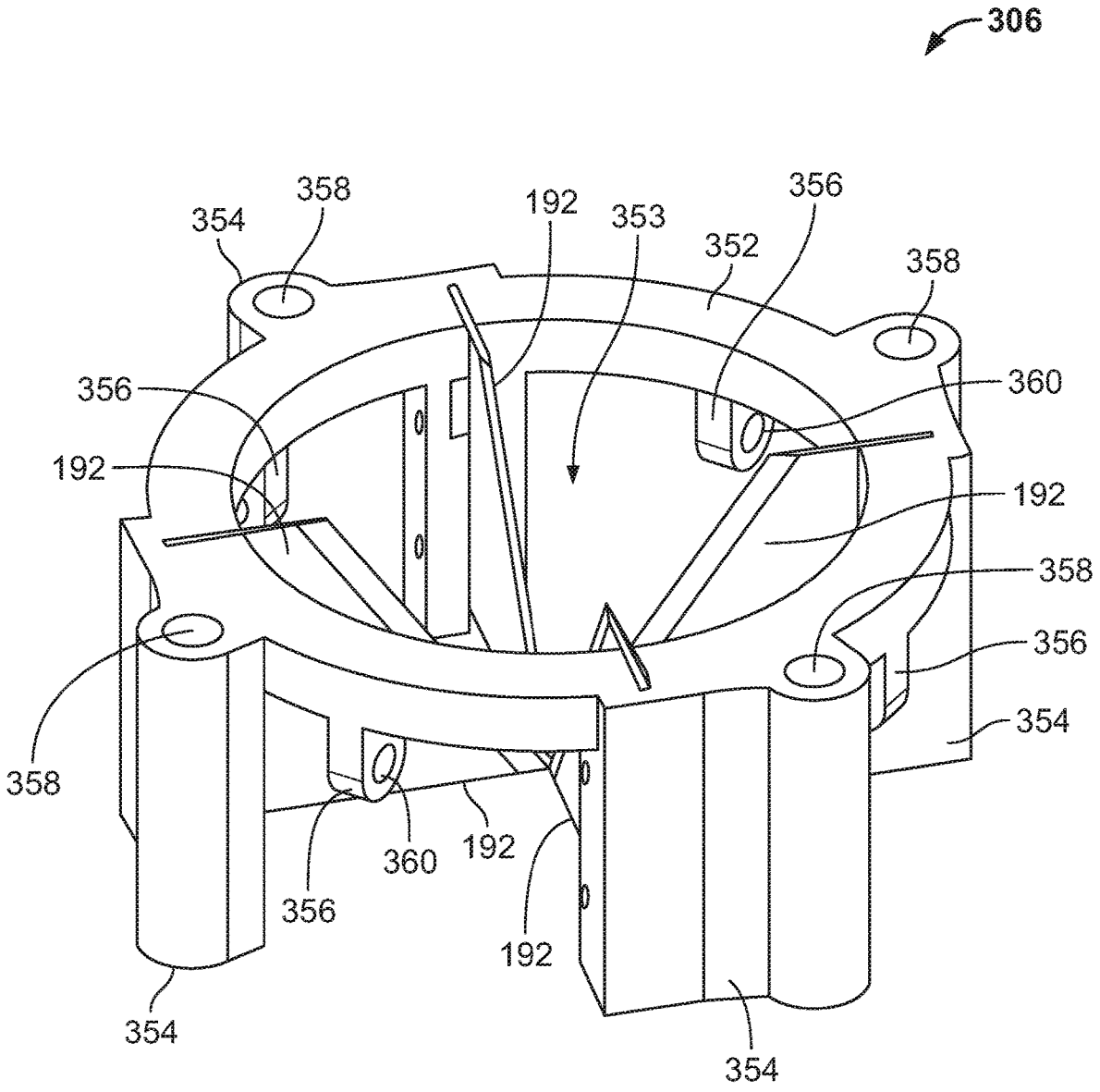
FIG. 24 is a perspective view of a blade mount ring of the centering guide of FIG. 14.

FIG. 24 is a perspective view of the blade mount ring 306. The blade mount ring 306 includes an annular body 352 defining a central opening 353, a plurality of mounting legs 354 (e.g., four), a plurality of linkage mounts 356 (e.g., four) extending from the annular body 352, and a plurality of blades 192 (e.g., four) secured to the annular body 352 and the mounting legs 354. The plurality of mounting legs 354 can include a mounting hole 358 configured to receive a rod 359 therethrough, which can be utilized to tie the blade mount ring 306, the first and second outer rings 308*a*, 308*b*, and the pivot mount ring 310 together, discussed in greater detail below. The plurality of linkage mounts 356 can be equidistantly spaced and extend from the annular body 352. Additionally, each of the plurality of linkage mounts 356 can include a mount hole 360 extending therethrough. The plurality of blades 192 extend radially inward toward the central axis A of the centering guide 304, with the cutting edge facing upward. The blade mount ring 306 can be stationary, e.g., so that it does not translate along the rods 359 extending through the mounting holes 358. As described above, the second pivot linkage 316*b* of each guide rail subassembly 312 is configured to be rotatably mounted to the blade mount ring 306. Specifically, the intermediate mounts 334*a*, 334*b* are configured to receive one of the linkage mounts 356 therebetween with the mount hole 360 aligned with the second pivot hole 340 extending through the intermediate mounts 334*a*, 334*b*. A pin can be inserted through the second pivot hole 340 and the mount hole 360 to permit rotation between the second pivot linkage 316*b* and the blade mount ring 306.

Figure 25:
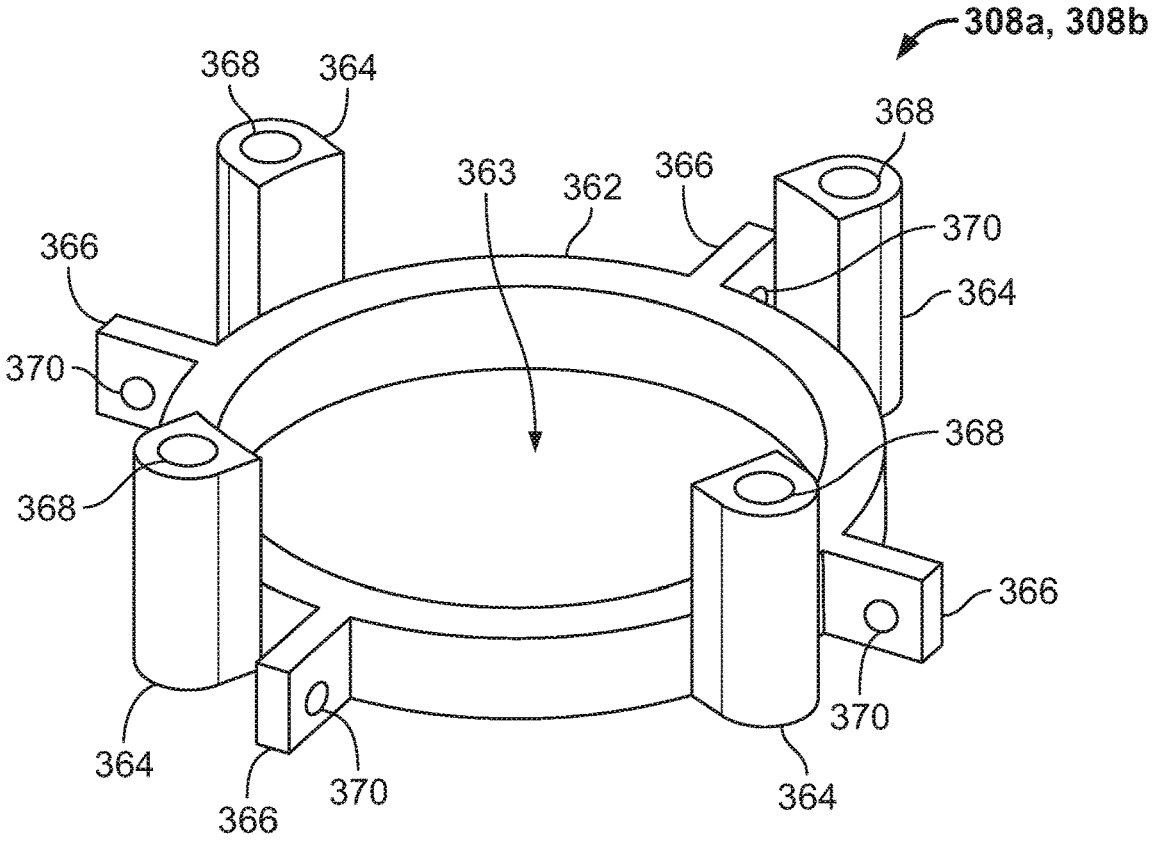
FIG. 25 is a perspective view of first and second outer rings of the centering guide of FIG. 14.

FIG. 25 is a perspective view of the first and second outer rings 308*a*, 308*b*, which can be identical in construction. The first and second outer rings 308*a*, 308*b* include an annular body 362 defining a central opening 363, a plurality of mounting extensions 364 (e.g., four), and a plurality of linkage extensions 366 (e.g., four). The plurality of mounting extensions 364 extend from the annular body 362 and each include a mounting hole 368 extending therethrough. The plurality of mounting extensions 364 are spaced and positioned so that the mounting holes 368 thereof are vertically aligned with the mounting holes 358 of the blade mount ring 306. Accordingly, the rod 359 can extend through the mounting holes 368 of the first and second outer rings 308*a*, 308*b* and the mounting holes 358 of the blade mount ring 306, thus vertically aligning the central opening 353 of the blade mount ring 306 with the central opening 363 of the first and second outer rings 308*a*, 308*b*. The first and second outer rings 308*a*, 308*b* can be configured to slide vertically along the rod, discussed in greater detail below. The plurality of linkage extensions 366 can be equidistantly spaced and extend radially from the annular body 362. Additionally, each of the plurality of linkage extensions 366 can include a mounting hole 370 extending therethrough.

As described above, the first forked linkage 318*a* is configured to be rotatably mounted to the first outer ring 308*a*. Specifically, the forked arms 346*a*, 346*b* of the first forked linkage 318*a* are configured to receive one of the plurality of linkage extensions 366 of the first outer ring 308*a* therebetween with the mounting hole 350 extending through the forked arms 346*a*, 346*b* aligned with the mounting hole 370 of the linkage extension 366. A pin can be inserted through the mounting hole 350 and extend through the forked arms 346*a*, 346*b* and the mounting hole 370 of the linkage extension to permit rotation between the first forked linkage 318*a* and the first outer ring 308*a*.

As described above, the second forked linkage 318*b* is configured to be rotatably mounted to the second outer ring 308*b*. Specifically, the forked arms 346*a*, 346*b* of the second forked linkage 318*b* are configured to receive one of the plurality of linkage extensions 366 of the second outer ring 308*b* therebetween with the mounting hole 350 extending through the forked arms 346*a*, 346*b* aligned with the mounting hole 370 of the linkage extension 366. A pin can be inserted through the mounting hole 350 and extend through the forked arms 346*a*, 346*b* and the mounting hole 370 of the linkage extension to permit rotation between the second forked linkage 318*b* and the second outer ring 308*b*.

Figure 26:
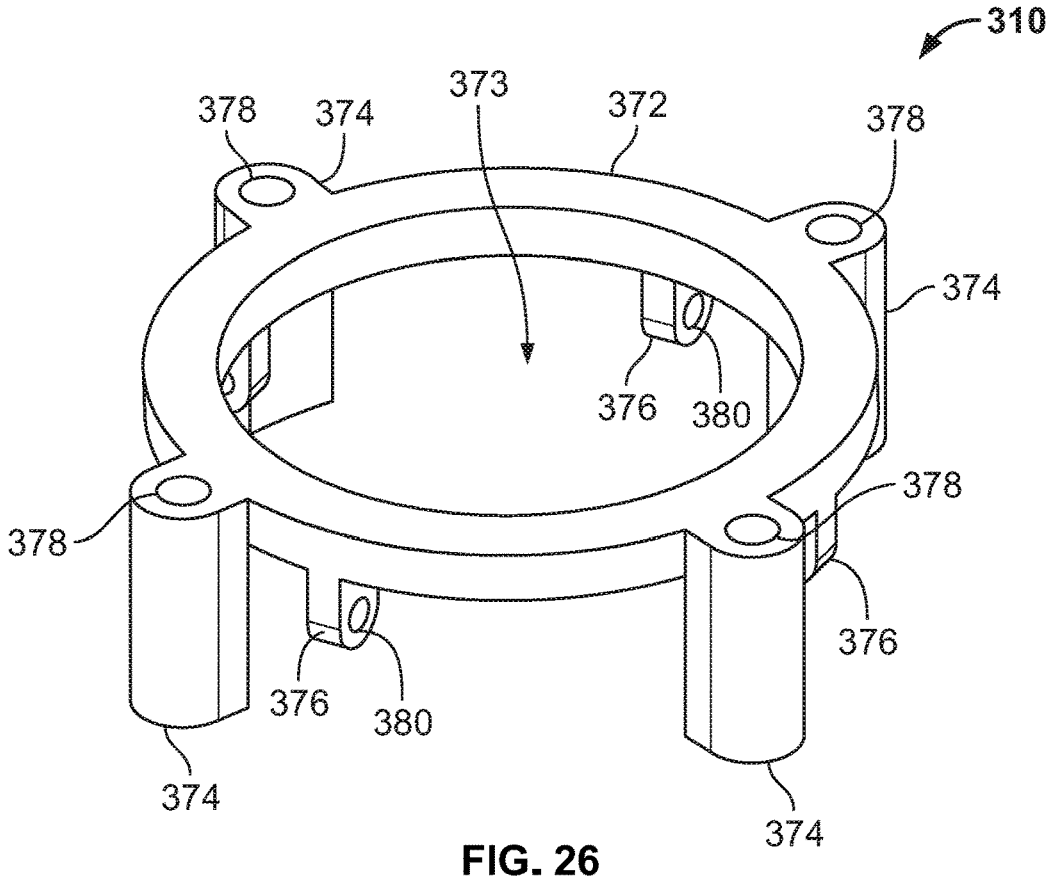
FIG. 26 is a perspective view of a pivot mount ring of the centering guide of FIG. 14.

FIG. 26 is a perspective view of the pivot mount ring 310. The pivot mount ring 310 includes an annular body 372 defining a central opening 373, a plurality of mounting legs 374 (e.g., four), and a plurality of linkage mounts 376 (e.g., four) extending from the annular body 372. Each of the plurality of mounting legs 374 can include a mounting hole 378 configured to receive the rod 359 therethrough. The plurality of mounting legs 374 are spaced and positioned so that the mounting holes 378 thereof are vertically aligned with the mounting holes 368 of the first and second outer rings 308*a*, 308*b* and the mounting holes 358 of the blade mount ring 306. Accordingly, the rod 359 can extend through the mounting holes 378 of the pivot mount ring 310, the mounting holes 368 of the first and second outer rings 308*a*, 308*b*, and the mounting holes 358 of the blade mount ring 306, thus vertically aligning the central opening 373 of the pivot mount ring 310 with the central opening 353 of the blade mount ring 306 and the central openings 363 of the first and second outer rings 308*a*, 308*b*. The pivot mount ring 310 can be configured to slide vertically along the rods, discussed in greater detail below. The plurality of linkage mounts 376 can be equidistantly spaced and extend from the annular body 372. Additionally, each of the plurality of linkage mounts 376 can include a mount hole 380 extending therethrough. As described above, the first pivot linkage 316*a* of each guide rail subassembly 312 is configured to be rotatably mounted to the pivot mount ring 310. Specifically, the intermediate mounts 334*a*, 334*b* are configured to receive one of the linkage mounts 376 therebetween with the mount hole 380 aligned with the second pivot hole 340 extending through the intermediate mounts 334*a*, 334*b*. A pin can be inserted through the second pivot hole 340 and the mount hole 380 to permit rotation between the first pivot linkage 316*a* and the pivot mount ring 310.

Accordingly, when the centering guide 304 is fully constructed, the blade mount ring 306 is at a bottom position, the second outer ring 308*b* is positioned above and adjacent the blade mount ring 306, the pivot mount ring 310 is positioned above and adjacent the second outer ring 308*b*, and the first outer ring 308*a* is positioned above and adjacent the pivot mount ring 310, such that the central opening 373 of the pivot mount ring 310, the central openings 363 of the first and second outer rings 308*a*, 308*b*, and the central opening 353 of the blade mount ring 306 are vertically aligned. Additionally, each of the guide rail subassemblies 312 (e.g., four) are equidistantly mounted to the blade mount ring 306, the first and second outer rings 308*a*, 308*b*, and the pivot mount ring 310, with the guide rails 314 thereof being spaced equidistantly and positioned within the central openings 353, 363, 373. Accordingly, engagement of the guide rail subassemblies 312 with the blade mount ring 306, the first and second outer rings 308*a*, 308*b*, and the pivot mount ring 310 allow for the guide rails 314 to be urged radially inward and outward respective to the central axis A, while the first outer ring 308*a*, the second outer ring 308*b*, and the pivot mount ring 310 are permitted to translate vertically along the rods.

As noted above, FIGS. 16, 18, and 20 are respectively perspective, side elevational, and top plan views of the centering guide 304 in the closed position, while FIGS. 17, 19, and 21 are respectively perspective, side elevational, and top plan views of the centering guide 304 in the open position. When the centering guide 304 is in the closed position (FIGS. 16, 18, and 20), the guide rail 314 of each guide rail subassembly 312 is positioned radially inward and closer to the central axis A, e.g., compared to the open position (FIGS. 17, 19, and 21), and is configured to engage a cucumber or other food product that is inserted into the centering guide 304. When the cucumber or other food product is inserted into the centering guide 340 it first contacts the tapered faces 324 of one or more of the guide rails 314, which center the cucumber between all of the guide rails 314. As the cucumber is urged further downward, e.g., by an actuator such as an air cylinder, it will engage and slide along the substantially vertical faces 322 of the guide rails 314 and urge the guide rails 314 radially outward, thus forcing the centering guide 304 into the open position based on the width of the cucumber. As the guide rails 314 are urged radially outward, each guide rail 314 will rotate with respect to the connected first pivot linkage 316*a*, each of the first pivot linkages 316*a* will be caused by the connected guide rail 314 to rotate with respect to the connected guide rail 314, linkage mount 376 of the pivot mount ring 310, and body 344 of the first forked linkage 318*a*, and each first forked linkage 318*a* will rotate with respect to the connected first pivot linkage 316*a* and the linkage extension 366 of the first outer ring 308*a*. This will cause the first outer ring 308*a* and the pivot mount ring 310 to translate along the rods 359 and move away from each other, e.g., the first outer ring 308*a* will be urged upward while the pivot mount ring 310 will be urged downward.

Moreover, movement of a single guide rail 314 radially outward causes all of the guide rails 314 to be moved radially outward by an equal amount, which maintains the cucumber in vertical alignment with the central axis A of the centering guide 304. This occurs because all of the first pivot linkages 316*a*, e.g., of all four of the guide rail subassemblies 312, are rotatably secured to a respective linkage mount 376 of the pivot mount ring 310, and all of the first forked linkages 318*a*, e.g., of all four of the guide rail subassemblies 312, are rotatably secured to a respective linkage extension 366 of the first outer ring 308*a*, That is, when one of the guide rails 314 is urged radially outward, the first pivot linkage 316*a* and the first forked linkage 318*a* associated with that guide rail 314 will cause the entire first outer ring 308*a* and the entire pivot mount ring 310 to separate from each other and translate along the rods. The vertical translation of the entire first outer ring 308*a* and the entire pivot mount ring 310 causes the first pivot linkage 316*a* and the first forked linkage 318*a* of the other guide rail subassemblies 312 to pull the guide rail 314 associated therewith radially outward and away from the central axis A of the centering guide 304. Thus, all of the guide rails 314 will move in unison, allowing the centering guide 304 to accommodate cucumbers of varying sizes, widths, and symmetries, while keeping such cucumbers centered.

As the cucumber is urged further downward through the centering guide 304 and along the substantially vertical faces 322 of the guide rails 314, e.g., along the central axis A, the lower portions of the guide rails 314 will be urged radially outward. As the lower portions of the guide rails 314 are urged radially outward, each guide rail 314 will rotate with respect to the connected second pivot linkage 316*b*, each of the second pivot linkages 316*b* will rotate with respect to the connected guide rail 314, linkage mount 356 of the blade mount ring 306, and body 344 of the second forked linkage 318*b*, and each second forked linkage 318*b* will rotate with respect to the connected second pivot linkage 316*b* and linkage extension 366 of the second outer ring 308*b*. This will cause the second outer ring 308*b* to translate along the rods 359 and move away from the blade mount ring 306, e.g., the second outer ring 308*b* will be urged upward away from the blade mount ring 306.

Moreover and as noted above, movement of a single guide rail 314 radially outward will result in all of the guide rails 314 being moved radially outward by an equal amount, which maintains the cucumber in vertical alignment with the central axis A of the centering guide 304. This is because all of the second pivot linkages 316*b*, e.g., of all four of the guide rail subassemblies 312, is rotatably secured to a respective linkage mount 356 of the blade mount ring 306, and all of the second forked linkages 318*b*, e.g., of all four of the guide rail subassemblies 312, is rotatably secured to a respective linkage extension 366 of the second outer ring 308*a*, That is, when one of the guide rails 314 is urged radially outward, the second pivot linkage 316*b* and the second forked linkage 318*b* associated with that guide rail 314 will cause the entire second outer ring 308*b* to separate from the entire blade mount ring 306 and translate along the rods. Vertical translation of the entire second outer ring 308*b* causes the second pivot linkage 316*b* and the second forked linkage 318*b* of the other guide rail subassemblies 312 to pull the guide rail 314 associated therewith radially outward and away from the central axis A of the centering guide 304. Thus, all of the guide rails 314 will move in unison, allowing the centering guide 304 to accommodate cucumbers of varying sizes, widths, and symmetries, while keeping such cucumbers centered.

Additionally, each of the guide rail subassemblies 312 can be spring biased toward the central axis A, e.g., by springs positioned between the first pivot linkages 116*a* and the pivot mount ring 310, and between the second pivot linkages 116*b* and the blade mount ring 306. Accordingly, the guide rail subassemblies 312 can be biased toward the closed position, and can return to the closed position once the cucumber is urged through the entirety of the centering guide 304.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

What is claimed is:

1. An apparatus for filling a central open space of a container, comprising:

a base;

an indexing station including a magazine, a blade, and a first actuator, the magazine rotatably mounted to the base;

a second actuator; and a filling station including one or more cartridges and a third actuator;

wherein the magazine is configured to receive a whole cucumber at a loading area of the indexing station and is configured to be incrementally indexed to reposition the whole cucumber from the loading area to a cutting area above the blade;

wherein the first actuator is configured to urge the whole cucumber through the blade to cut the whole cucumber into a plurality of spears;

wherein at least four of the plurality of spears drop into and are held by a first cartridge of the one or more cartridges of the filling station, the second actuator is configured to urge a first set of two opposing spears from the first cartridge into a central open space of a first container, the first cartridge is incrementally indexed to a position above a second container, and the third actuator is configured to urge a second set of two opposing spears from the first cartridge into a central open space of the second container.

2. The apparatus according to claim 1, wherein the magazine is rotatably disposed within a housing.

3. The apparatus according to claim 1, wherein the indexing station includes a top cover that covers a partial radial portion of the magazine at the cutting area.

4. The apparatus according to claim 1, wherein the loading area of the indexing station includes a tapered infeed chute configured to position the whole cucumber in the magazine.

5. The apparatus according to claim 1, wherein the magazine defines a cylindrical shape with cutouts radially disposed along a perimeter of the magazine, each cutout configured to retain a whole cucumber.

6. The apparatus according to claim 5, wherein the cutouts are half-circle cutouts configured to surround half of a whole cucumber.

7. The apparatus according to claim 1, wherein the whole cucumber is maintained in a vertical position between the magazine and an inner surface of a housing of the indexing station.

8. The apparatus according to claim 1, wherein the blade is cross shaped.

9. The apparatus according to claim 1, wherein the blade cuts the whole cucumber into four equal spears.

10. The apparatus according to claim 1, wherein the filling station includes a top platform and a bottom platform, the one or more cartridges mounted between the top and bottom platforms.

11. The apparatus according to claim 10, comprising a guide positioned between the indexing station and the top platform of the filling station, the guide surrounding the blade.

12. The apparatus according to claim 1, wherein the one or more cartridges of the filling station are rotatably mounted relative to the indexing station, the one or more cartridges being incrementally indexed from a position below the blade to a position above the first container or the second container.

13. The apparatus according to claim 12, wherein the magazine rotates about a first vertical axis and the one or more cartridges rotate about a second vertical axis, the first and second vertical axes being parallel to, and spaced apart from, each other.

14. The apparatus according to claim 1, wherein the one or more cartridges of the filling station are incrementally indexed to reposition the one or more spears from a position below the blade to a position above the first container having the central open space, the second container having the central open space, or another container having a central open space.

15. The apparatus according to claim 1 in combination with the first container and the second container.

16. The apparatus according to claim 1, wherein the first container comprises a jar.

17. The apparatus according to claim 1, wherein each of the one or more cartridges includes a housing and one or more plates dividing the housing into equally sized inner chambers, each inner chamber configured to receive a spear.

18. The apparatus according to claim 17, wherein each of the one or more cartridges includes a spring-biased keeper configured to impart a force on the spear to maintain the spear within the inner chamber.

19. The apparatus according to claim 1, comprising a sensor configured to detect if the central open space of the container is obstructed, the sensor preventing the second actuator from being actuated if an obstruction is detected.

20. An apparatus for filling a central space of a container, comprising:

a base;

an indexing station including a magazine, a blade, and a first actuator, the magazine rotatably mounted to the base;

a second actuator; and a filling station including one or more cartridges and a third actuator, the one or more cartridges including at least a first cartridge, a second cartridge, and a third cartridge; and wherein the magazine is configured to receive a whole cucumber at a loading area of the indexing station and is configured to be incrementally indexed to reposition the whole cucumber from the loading area to a cutting area above the blade;

wherein the first actuator is configured to urge the whole cucumber through the blade to cut the whole cucumber into a plurality of spears;

wherein at least one of the plurality of spears drop into and are held by at least one of the one or more cartridges of the filling station, and the second actuator is configured to push at least one of the spears out from the cartridge into a central open space of a container; and wherein the first cartridge is positioned below the blade and contains no spears, the second cartridge is positioned above the first container and contains a first plurality of spears, and the third cartridge is positioned above the second container and contains a second plurality of spears, the second plurality of spears being less than the first plurality of spears.

21. The apparatus according to claim 20, wherein upon an actuation (i) the first actuator urges the whole cucumber through the blade cutting the whole cucumber into a third plurality of spears that are transferred into the first cartridge, (ii) the second actuator urges at least one of the first plurality of spears from the second cartridge into a central open space of a first container, and (iii) a third actuator urges at least one of the second plurality of spears from the third cartridge into a central open space of the second container.

22. The apparatus according to claim 21, wherein upon completion of the actuation (i) the first and second containers are indexed and replaced by third and fourth containers, (ii) the first cartridge contains the third plurality of spears and is incrementally indexed to a position above the third container, (iii) the second cartridge contains a fourth plurality of spears and is incrementally indexed to a position above the fourth container, and (iv) the third container contains no spears and is incrementally indexed to a position below the blade.

23. A system for filling a central open space of a container with one or more cucumber spears, comprising:

a filling apparatus including:

a base;

an indexing station including a magazine and a blade, the magazine rotatably mounted to the base;

a filling station including one or more cartridges, the one or more cartridges rotatably mounted relative to the indexing station; and an indexer configured to move containers along a path below the filling station;

wherein the magazine of the indexing station is configured to receive a whole cucumber at a loading area and is incrementally indexed to reposition the whole cucumber from the loading area to a cutting area above the blade;

wherein the indexing station includes a first actuator configured to urge the whole cucumber through the blade to cut the whole cucumber into spears;

wherein a first cartridge of the one or more cartridges of the filling station is configured to receive and hold the spears;

wherein the first cartridge is indexed to reposition the first cartridge having the spears above a first container with a central open space;

wherein the filling station includes a second actuator configured to urge a first set of two opposing spears from the first cartridge into the central open space of the first container;

wherein the first cartridge is incrementally indexed to reposition the first cartridge above a second container with a central open space; and wherein a third actuator is configured to urge a second set of two opposing spears from the first cartridge into the central open space of the second container.

24. The system according to claim 23, wherein the indexer is a helical indexer rotatably disposed on one side of the containers.

25. The system according to claim 24, comprising a guiding wall disposed on an opposing side of the containers from the helical indexer.

26. The system according to claim 23, wherein the indexer moves the containers along a linear path below the filling station.

27. A method of filling a central open space in a container, comprising:

providing an apparatus including (i) a base, (ii) an indexing station including a magazine and a blade, the magazine rotatably mounted to the base, and (iii) a filling station including one or more cartridges;

loading a whole cucumber into the platform of the cutting station at a loading area;

incrementally indexing the platform to reposition the whole cucumber from the loading area to a cutting area above the blade;

urging the whole cucumber through the blade with an actuator of the cutting station to cut the whole cucumber into spears;

transferring the spears into a first cartridge of the one or more cartridges of the filling station;

urging a first set of two opposing spears from the first cartridge into a central open space of a first container with a first actuator of the filling station; and incrementally indexing the first cartridge to a position above a second container.

28. The method according to claim 27, comprising incrementally indexing the one or more cartridges of the filling station to reposition the spears from a position below the blade to a position above a container having a central open space.

29. The method according to claim 27, comprising urging a second set of two opposing spears from the first cartridge into a central open space of the second container with a second filling actuator.

30. A cartridge for holding cucumber spears, comprising:

a body having a top opening and a bottom opening, the body defining an internal chamber configured to receive a cut cucumber spear through the top opening;

a mount extending from the body; and a keeper assembly secured to the mount, the keeper assembly, comprising:

a keeper arm; and a spring;

wherein the spring biases the keeper arm radially inward into the internal chamber to impart a force on a spear positioned within the internal chamber to secure the spear within the internal chamber and prevent the spear from falling through the bottom opening.

31. The cartridge according to claim 30, wherein the top opening is configured to receive an arm that pushes the spear out from the internal chamber and through the bottom opening.

32. The cartridge according to claim 30, wherein the keeper arm is secured to the mount by a pin, the keeper arm being rotatable about the pin.

33. The cartridge according to claim 30, wherein the body includes a removed section, the keeper arm extending through the removed section and into the internal chamber.

34. The cartridge according to claim 30, comprising one or more plates dividing the internal chamber into a plurality of equally sized inner chambers, each inner chamber configured to receive a spear.

35. The cartridge according to claim 34, comprising a plurality of mounts equal in number to the number of equally sized inner chambers, and a plurality of keeper assemblies equal in number to the number of equally sized inner chambers, each of the keeper assemblies having a keeper arm and a spring, wherein each of the mounts and each of the keeper assemblies is associated with one of the inner chambers, wherein the spring of each keeper assembly biases the respective keeper arm radially inward into the associated inner chamber to impart a force on a spear positioned within the inner chamber to secure the spear within the inner chamber and prevent the spear from falling through the bottom opening.

36. The cartridge according to claim 35, wherein the body includes a plurality of removed sections equal in number to the number of equally sized inner chambers, each of the keeper arms extending through one of the removed sections and into the associated inner chamber.

37. A centering guide for a food product, comprising:

a blade mount ring defining a first central opening, and including one or more blades positioned at least partially within the first central opening;

a first outer ring defining a second central opening, the first outer ring configured to translate axially along a central axis;

a second outer ring defining a third central opening, the second outer ring configured to translate axially along the central axis;

a pivot mount ring defining a fourth central opening, the pivot mount ring configured to translate axially along the central axis; and a plurality of guide rail subassemblies each mounted with respect to the blade mount ring, the first outer ring, the second outer ring, and the pivot mount ring, each of the plurality of guide rail subassemblies comprising:

a guide rail;

a first linkage subassembly rotatably engaged with the guide rail, the first outer ring, and the pivot mount ring; and a second linkage subassembly rotatably engaged with the guide rail, the second outer ring, and the blade mount ring;

wherein the guide rails are (1) positioned within the first central opening, the second central opening, the third central opening, and the fourth central opening, (2) configured to receive the food product between the guide rails, and (3) configured to be urged radially outward by the food product from a closed position to an open position when the food product is received between the guide rails, and wherein the plurality of guide rail subassemblies maintain the food product substantially along the central axis when they are urged radially outward by the food product.

38. The centering guide of claim 37, wherein urging the guide rail of at least one of the plurality of guide rail subassemblies radially outward from the central axis causes the guide rail of each of the other guide rail subassemblies to move radially outward from the central axis and maintain the food product substantially along the central axis.

39. The centering guide of claim 37, wherein the first linkage subassembly causes the first outer ring and the pivot mount ring to translate axially when at least one of the guide rails is urged radially outward from the central axis.

40. The centering guide of claim 39, wherein the first outer ring and the pivot mount ring are mounted to a plurality of rods and configured to translate axially along the plurality of rods.

41. The centering guide of claim 37, wherein the second linkage subassembly causes the second outer ring to translate axially when at least one of the guide rails is urged radially outward from the central axis.

42. The centering guide of claim 41, wherein the second outer ring is mounted to a plurality of rods and configured to translate axially along the plurality of rods.

43. The centering guide of claim 37, wherein the first linkage subassembly includes a first pivot linkage and a first forked linkage, and the second linkage subassembly includes a second pivot linkage and a second forked linkage.

44. The centering guide of claim 43, wherein the first pivot linkage is rotatably secured with the guide rail, the pivot mount ring, and the first forked linkage, wherein the first forked linkage is rotatably secured with the first outer ring and the first pivot linkage, wherein the second pivot linkage is rotatably secured with the guide rail, the blade mount ring, and the second forked linkage, and wherein the second forked linkage is rotatably secured with the second outer ring and the second pivot linkage.

45. The centering guide of claim 37, wherein the guide rail includes a tapered face and a substantially vertical face configured to engage the food product.

46. The centering guide of claim 37, wherein the plurality of guide rail subassemblies includes four guide rail subassemblies that are equidistantly spaced.

* * * * *